US009492857B2

(12) United States Patent
Hasenberg et al.

(10) Patent No.: US 9,492,857 B2
(45) Date of Patent: Nov. 15, 2016

(54) HAND HELD FLARING TOOL

(75) Inventors: Mark J. Hasenberg, Kenosha, WI (US); Logan D. Pitts, North Muskegon, MI (US); John M. Peirce, Portage, MI (US)

(73) Assignee: AMERICAN GREASE STICK COMPANY, Muskegon, MI (US)

( * ) Notice: Subject to any disclaimer, the term of this patent is extended or adjusted under 35 U.S.C. 154(b) by 382 days.

(21) Appl. No.: 13/813,471

(22) PCT Filed: Aug. 3, 2011

(86) PCT No.: PCT/US2011/046354

§ 371 (c)(1),
(2), (4) Date: Jan. 31, 2013

(87) PCT Pub. No.: WO2012/018875

PCT Pub. Date: Feb. 9, 2012

(65) Prior Publication Data

US 2013/0133394 A1 May 30, 2013

Related U.S. Application Data

(60) Provisional application No. 61/371,317, filed on Aug. 6, 2010.

(51) Int. Cl.

| | |
|---|---|
| ***B21D 19/00*** | (2006.01) |
| ***B21D 19/04*** | (2006.01) |
| ***B21D 41/02*** | (2006.01) |

(52) U.S. Cl.

CPC ..... *B21D 19/00* (2013.01); *B21D 41/021* (2013.01); *B21D 19/04* (2013.01); *B21D 41/02* (2013.01)

(58) Field of Classification Search

CPC ..... B21D 19/04; B21D 41/02; B21D 39/18; B21D 39/14; B21D 39/16; B21D 39/206

USPC ..... 72/20.3, 312; 269/254 CS, 3, 6, 95

See application file for complete search history.

(56) References Cited

U.S. PATENT DOCUMENTS

| | | | |
|---|---|---|---|
| 613,393 | A | 11/1898 | Pederson |
| 1,643,609 | A | 9/1927 | Roepke |

(Continued)

FOREIGN PATENT DOCUMENTS

| | | |
|---|---|---|
| CN | 201150965 | 11/2008 |
| DE | 8902521 | 6/1989 |

(Continued)

OTHER PUBLICATIONS

International Search Report and Written Opinion dated Jan. 5, 2012 from corresponding PCT Application No. PCT/US2011/046354, filed Aug. 3, 2011.

*Primary Examiner* — Jimmy T Nguyen
*Assistant Examiner* — Gregory Swiatocha
(74) *Attorney, Agent, or Firm* — Gardner, Linn, Burkhart & Flory, LLP

(57) ABSTRACT

A hand held flaring tool includes a receiving portion for receiving an end of a tube, a stop element, a locking mechanism and a flaring mechanism. The stop element is movably disposed at the receiving portion and is movable between a stopping position, where the stop element limits insertion of the tube at the receiving portion to set the tube at an appropriate location for flaring the end of the tube, and a flaring position, where the stop element is moved to a position remote from the end of the tube. The locking mechanism is operable to lock the tube at the receiving portion when the tube is inserted into engagement with the stop element. The flaring mechanism is operable to move a flaring mandrel towards and into engagement with the end of the tube to flare the end of the tube.

48 Claims, 27 Drawing Sheets

(56) References Cited

U.S. PATENT DOCUMENTS

| | | | | |
|---|---|---|---|---|
| 1,882,975 | A | 12/1929 | Schmidt | |
| 2,421,667 | A * | 6/1947 | Miles et al. | 72/123 |
| 2,438,999 | A * | 4/1948 | Hartley et al. | 72/20.3 |
| 2,455,663 | A | 12/1948 | Eaton | |
| 2,478,102 | A | 8/1949 | Hull et al. | |
| 2,480,762 | A | 8/1949 | Parker | |
| 2,664,619 | A | 1/1954 | Hahn et al. | |
| 2,707,107 | A | 4/1955 | Tucker | |
| 2,993,522 | A | 7/1961 | Temple et al. | |
| RE25,131 | E | 3/1962 | Wilson | |
| 3,192,758 | A | 7/1965 | Catlin et al. | |
| 3,194,040 | A | 7/1965 | Rasmussen | |
| 3,348,292 | A | 10/1967 | Turner et al. | |
| 3,393,549 | A | 7/1968 | Gregg | |
| 3,470,724 | A | 10/1969 | Gregg | |
| 3,571,896 | A | 3/1971 | Wilkerson | |
| 3,771,343 | A | 11/1973 | Dawson | |
| 3,820,375 | A | 6/1974 | Koski | |
| 4,057,277 | A | 11/1977 | Burkholder | |
| 4,087,225 | A * | 5/1978 | Wolcott | B29C 57/00 425/392 |
| 4,127,021 | A | 11/1978 | Johnson | |
| 4,213,320 | A | 7/1980 | Vydrin et al. | |
| 4,456,293 | A | 6/1984 | Panissidi | |
| 4,492,105 | A | 1/1985 | Kutz et al. | |
| 4,606,214 | A | 8/1986 | Miyazaki | |
| 4,929,009 | A | 5/1990 | Vandersluis et al. | |
| 5,090,226 | A | 2/1992 | Takeoka et al. | |
| 5,184,404 | A | 2/1993 | Chen | |
| 5,228,323 | A | 7/1993 | Dubinsky et al. | |
| 5,375,309 | A * | 12/1994 | Dunn | 29/237 |
| 5,782,128 | A * | 7/1998 | Barjesteh | B21D 19/08 72/318 |
| 5,845,888 | A | 12/1998 | Anderson | |
| 5,956,987 | A * | 9/1999 | Anthoine | 72/21.5 |
| 6,508,097 | B2 | 1/2003 | Ose | |
| 6,619,099 | B2 | 9/2003 | Barjesteh | |
| 6,994,009 | B2 | 2/2006 | Carter | |
| 7,114,358 | B2 * | 10/2006 | Lamb | 72/125 |
| 7,114,423 | B2 | 10/2006 | Kelley | |
| 7,284,406 | B2 * | 10/2007 | Krauss | 72/370.1 |
| 7,318,334 | B2 | 1/2008 | Carter | |
| 7,353,682 | B2 * | 4/2008 | Buchanan | 72/317 |
| 7,604,472 | B2 | 10/2009 | Hayes, Jr. et al. | |
| 8,291,737 | B2 * | 10/2012 | Huang et al. | 72/120 |
| 2003/0204943 | A1 | 11/2003 | Geurts | |
| 2004/0096286 | A1 * | 5/2004 | Hsiao | 408/239 R |
| 2005/0150270 | A1 | 7/2005 | Berghaus | |
| 2005/0223773 | A1 * | 10/2005 | Boatright et al. | 72/448 |
| 2005/0229668 | A1 | 10/2005 | Carter | |
| 2006/0144116 | A1 | 7/2006 | Buchanan | |
| 2008/0203680 | A1 * | 8/2008 | Rohm et al. | 279/74 |
| 2010/0084039 | A1 | 4/2010 | Hayes, Jr. et al. | |
| 2010/0263202 | A1 | 10/2010 | Baba | |
| 2011/0247386 | A1 | 10/2011 | Buchanan | |
| 2011/0247387 | A1 | 10/2011 | Buchanan | |
| 2013/0133394 | A1 | 5/2013 | Hasenburg et al. | |

FOREIGN PATENT DOCUMENTS

| | | |
|---|---|---|
| DE | 3837444 | 1/1990 |
| DE | 4200020 | 7/1993 |
| DE | 19754452 | 6/1999 |
| DE | 102007030870 | 10/2008 |
| FR | 2692291 | 12/1993 |
| GB | 2095741 | 10/1982 |
| GB | 2292661 | 3/1996 |

* cited by examiner

HAND HELD FLARING TOOL

CROSS REFERENCE TO RELATED APPLICATION

The present application is a 371 national phase application of PCT Application No. PCT/US2011/046354, filed Aug. 3, 2011, which claims the benefits of U.S. provisional application Ser. No. 61/371,317, filed Aug. 6, 2010, which is hereby incorporated herein by reference in its entirety.

FIELD OF THE INVENTION

The present invention relates generally to flaring tools for flaring an end of a pipe or tube and, more particularly, to a hand held flaring tool for flaring an end of a pipe or tube of an automobile, such as a brake line or the like, at or near the automobile.

BACKGROUND OF THE INVENTION

Flaring tools are known and typically are cumbersome to use and require the use of both hands to clamp the tube at the tool and to flare end of the tube. Typically, it is difficult to set the depth of the tube into the flaring tool so that the flare is properly achieved.

SUMMARY OF THE INVENTION

The present invention provides a hand held flaring tool for flaring an end of a tube or pipe that is inserted into and secured or locked in the hand held flaring tool. The flaring tool may have a stop element or feature that automatically sets the depth of the tube or pipe at the flaring tool and that allows the user to set the tube insertion depth, lock the tube in place and flare the end of the tube, all with the same hand held tool and without having to visually line up the end of the tube with the flaring tool and without having to use both hands to hold the tube and lock and flare the end of the tube. The flaring tool may have a multi-piece collet that is movable relative to a collar of the flaring tool to clamp the collet onto the tube, with the collet comprising an internal biasing element to urge the collet towards its expanded state when the collet is moved to and disposed at a larger diameter portion of the collar. The flaring tool may have a reversible flaring mandrel that a user may use to flare the end of tube in one manner (such as a bubble flare) and then the user may flip or reverse the double-ended flaring mandrel to flare the end of the tube in a second manner (such as a conical flare), without having to disassemble the flaring tool or replace the mandrel. The flaring tool may have a multi-stage flaring actuator or pneumatic cylinder to provide enhanced control and enhanced forces at the flaring mandrel and end of the tube responsive to pressurized air or fluid at an input end of the actuator or cylinder, or the flaring tool may have a rotational driving means for rotatably driving a threaded rod of the flaring tool to drive the mandrel into engagement with the end of the tube to flare the tube.

These and other objects, advantages, purposes, and features of the present invention will become apparent upon review of the following specification in conjunction with the drawings.

DESCRIPTION OF THE PREFERRED EMBODIMENTS

Figure 1:
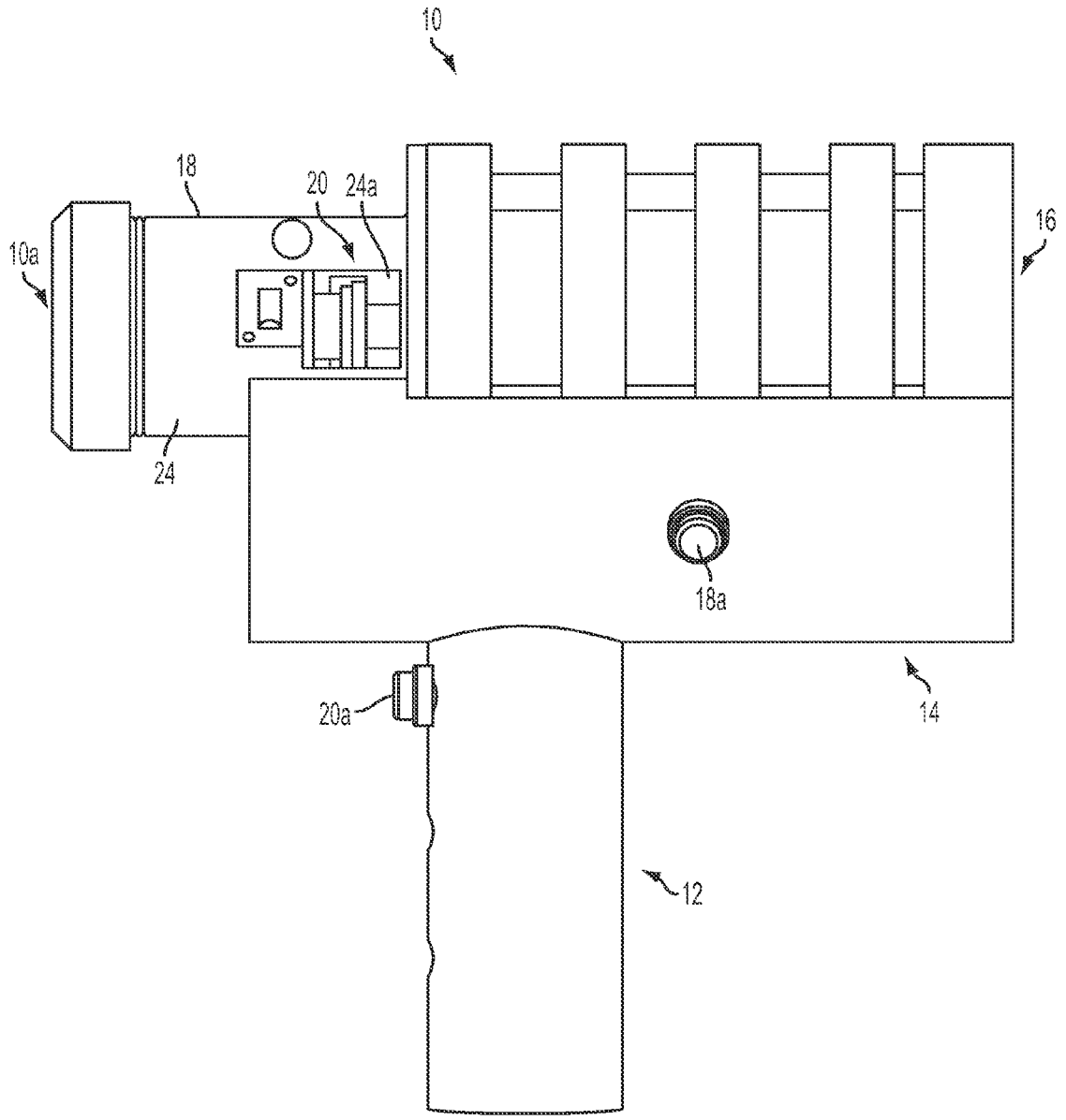
FIG. 1 is a side elevation of a hand held flaring tool in accordance with the present invention.
Figure 2:
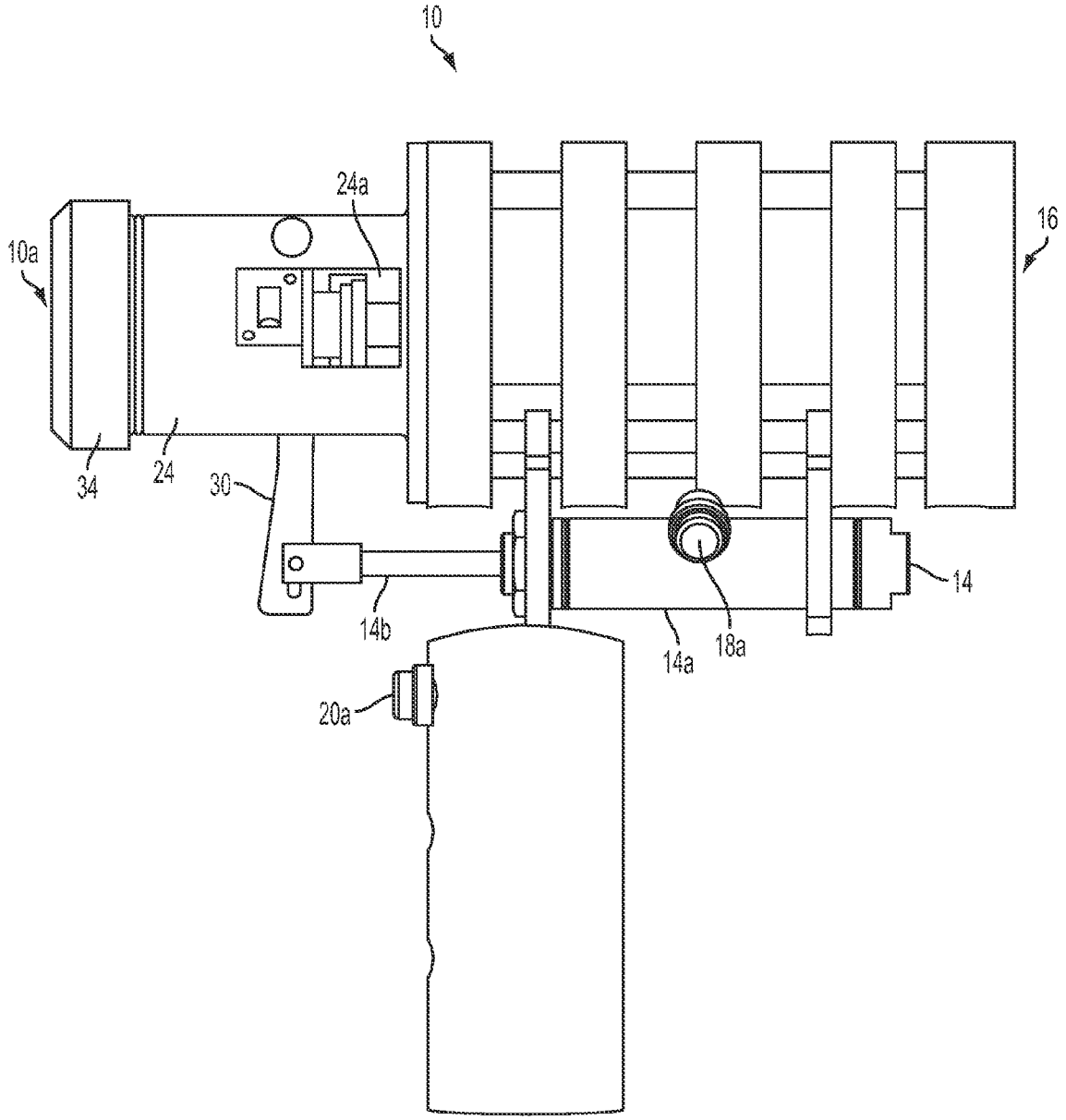
FIG. 2 is a side elevation of the flaring tool of FIG. 1, with portions removed to show additional details.
Figure 3:
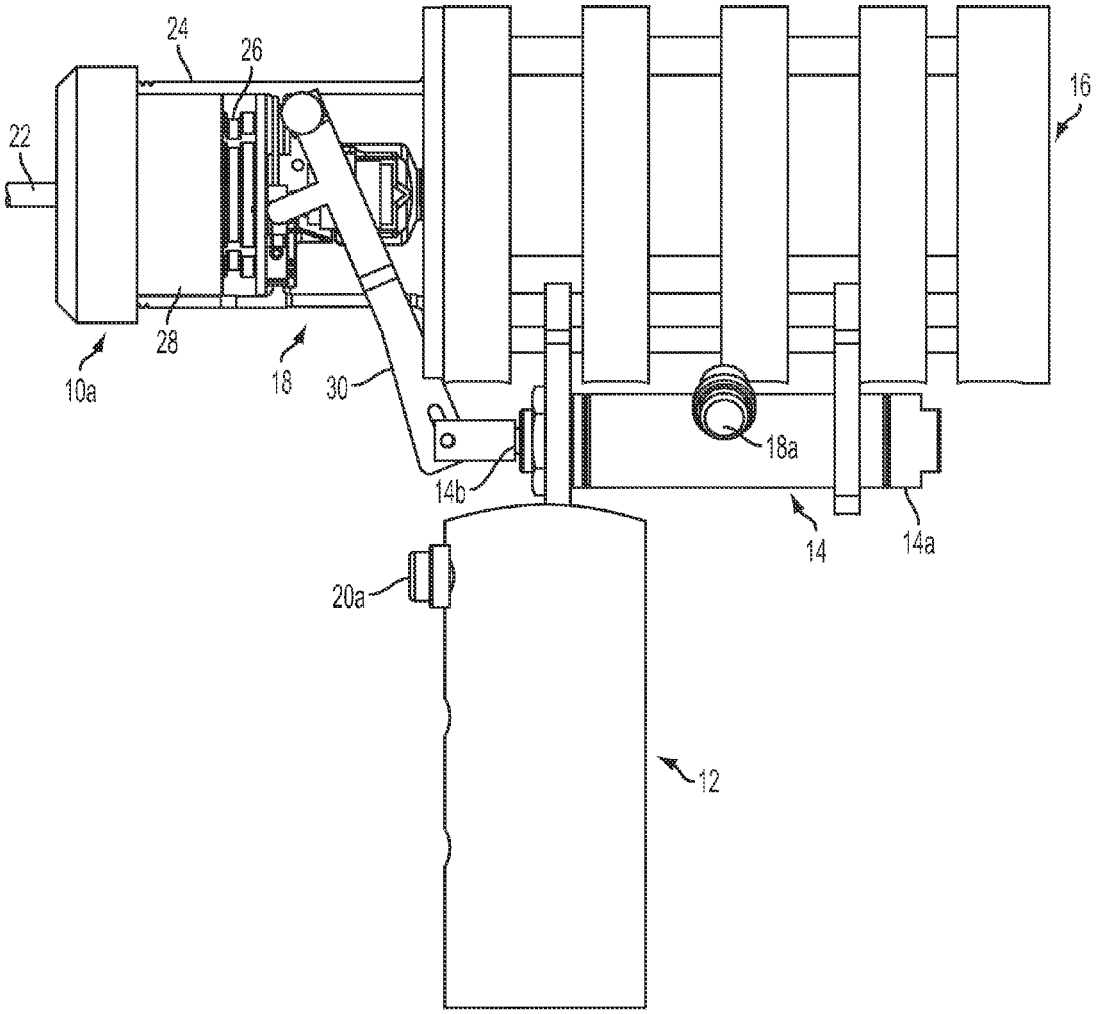
FIG. 3 is another side elevation of the flaring tool of FIG. 1, with additional portions removed to show additional details, and with the tool in a receiving state for receiving an end of a pipe or tube therein.

Referring now to the drawings and the illustrative embodiments depicted therein, a hand held flaring tool 10 comprises a handle portion 12, a locking actuator 14, a flaring actuator 16, a locking mechanism 18 and a flaring mechanism 20 (FIGS. 1-3). The tool 10 may be held by a user and a tube or pipe 22 (FIG. 3) may be inserted into the receiving end or portion 10*a* of the flaring tool 10, whereby the user may first actuate the locking mechanism 18 (such as via actuating a user input or button or switch 18*a*) to lock the tube at the appropriate location and depth in the flaring tool 10, and then may actuate the flaring mechanism 20 (such as via actuating a user input or button or switch 20*a*) to flare the end of the tube to the desired form or shape, as discussed below. The flaring tool 10 thus may automatically lock the tube at the desired or appropriate location and then flare the end of the tube, without the user having to visually align the tube at a particular location and without the user having to perform any manual locking steps or the like (other than simply actuating the user inputs 18*a*, 20*a*) to secure the tube at and in the flaring tool and to flare the end of the tube, as also discussed below.

As shown in FIGS. 1-3, 5-8, 11, 12, 15, 16 and 19-21, handle portion 12 comprises a generally cylindrical shaped handle or grip portion (or any suitable shape for a user's hand to readily grasp and conform to) and extends downward from the locking actuator 14 and flaring actuator 16 and the locking and flaring mechanisms 18, 20. User input 20*a* (for actuating the flaring mechanism 20) may be disposed at and accessible at the handle portion 12 and may comprise a button or trigger or switch at the handle portion for a user to readily press or squeeze or actuate while holding the handle portion 12 of flaring tool 10. Similarly, user input 18*a* (for actuating the locking mechanism 18) may be disposed at the handle portion 12 or may be disposed at or near the locking actuator 14, and may comprise a button or trigger or switch at or near the handle portion for a user to readily press or squeeze or actuate while holding the handle portion 12 of flaring tool 10. A user of the flaring tool thus may readily grasp and hold onto the handle portion to support the tool (and the tube or pipe inserted therein) during the flaring process, and may readily access and actuate the user inputs to clamp the locking mechanism onto the tube or pipe and to flare the end of the tube or pipe via the flaring mechanism. The flaring tool is sized to be small enough that a user can readily hold and support the flaring tool during the flaring process and may be able to use the flaring tool to flare an end of a tube or pipe that is already installed in the engine compartment of a vehicle or the like.

In the illustrated embodiment, the handle 12 is attached or supported at the locking actuator 14, which may comprise a pneumatic cylinder 14*a* or solenoid valve that extends and retracts a rod or piston 14*b* to actuate the locking mechanism 18 to clamp the tube in the flaring tool 10. Locking mechanism 18 is housed within a housing 24 of flaring tool 10. Housing 24 comprises a generally cylindrical housing that is disposed at an end of flaring actuator 16 and that houses the locking mechanism 18 and flaring mechanism 20. Locking mechanism 18 comprises a multi-piece collet 26 that is movably received in a collar element 28 (attached at an outer end of housing 24 distal from flaring actuator 16) and that is moved relative to the collar element 28 via a lever or collet moving element 30 connected to rod 14*b* of locking actuator 14.

Figure 4:
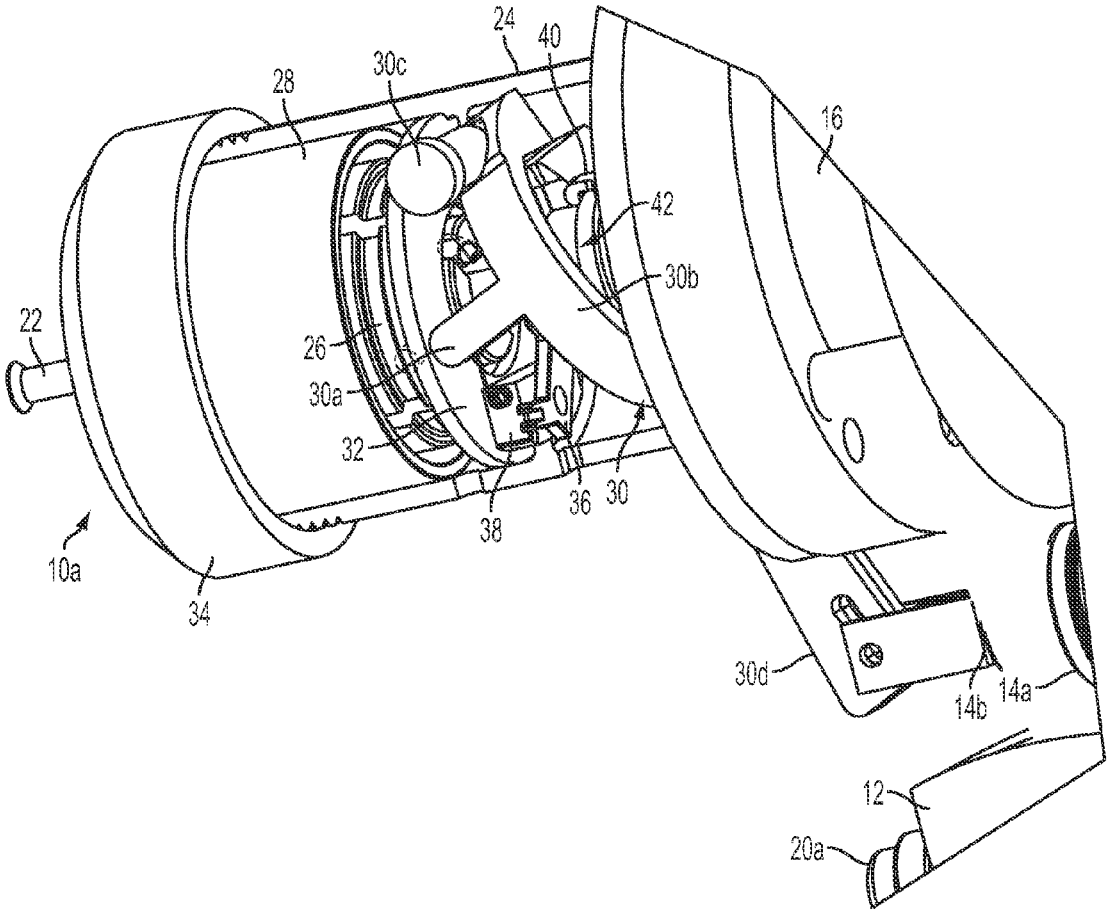
FIG. 4 is an enlarged perspective view of the collet and locking mechanism of the flaring tool of FIG. 3.
Figure 5:
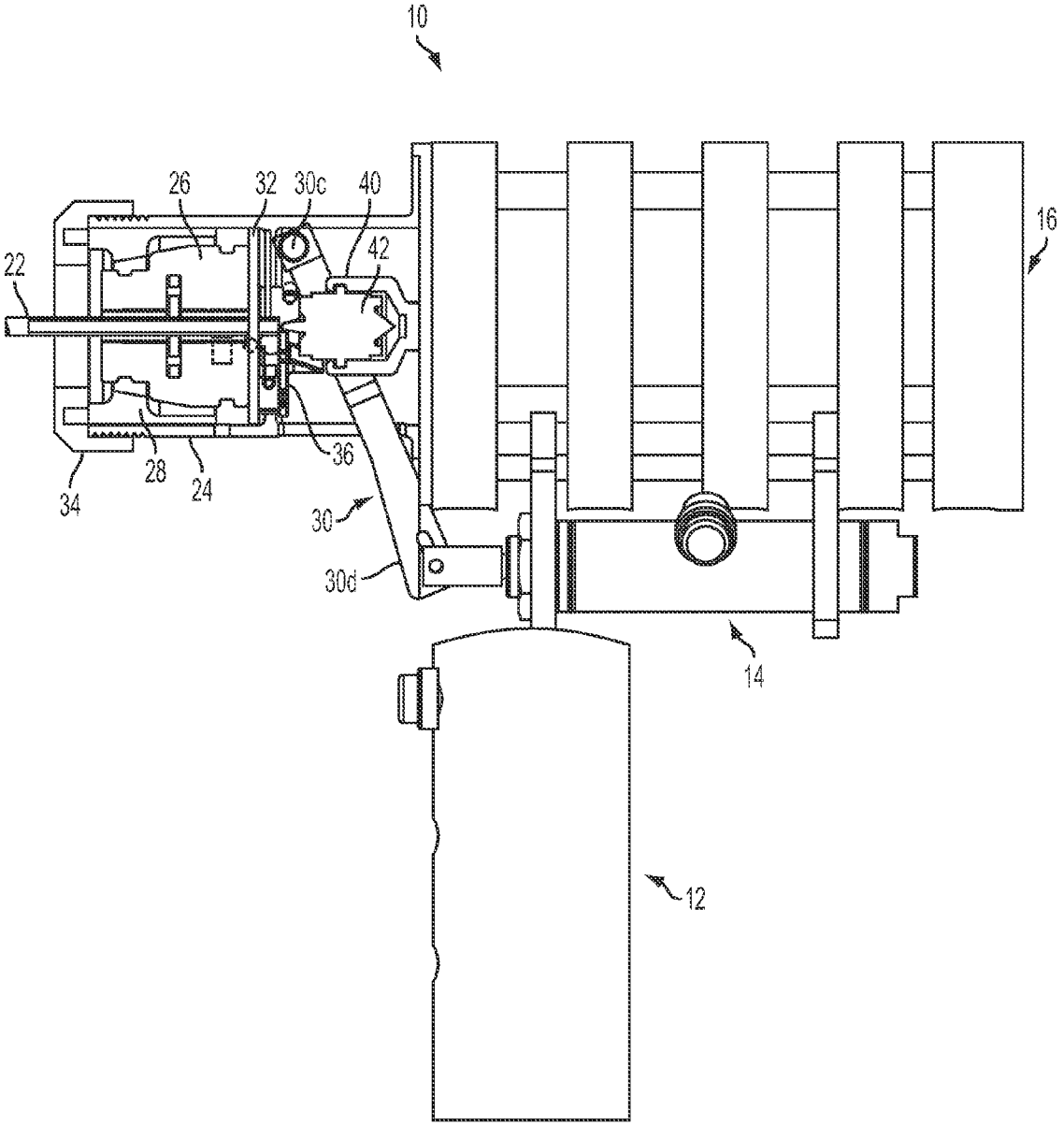
FIG. 5 is a side elevation and partial sectional view of the flaring tool of FIG. 3.
Figure 6:
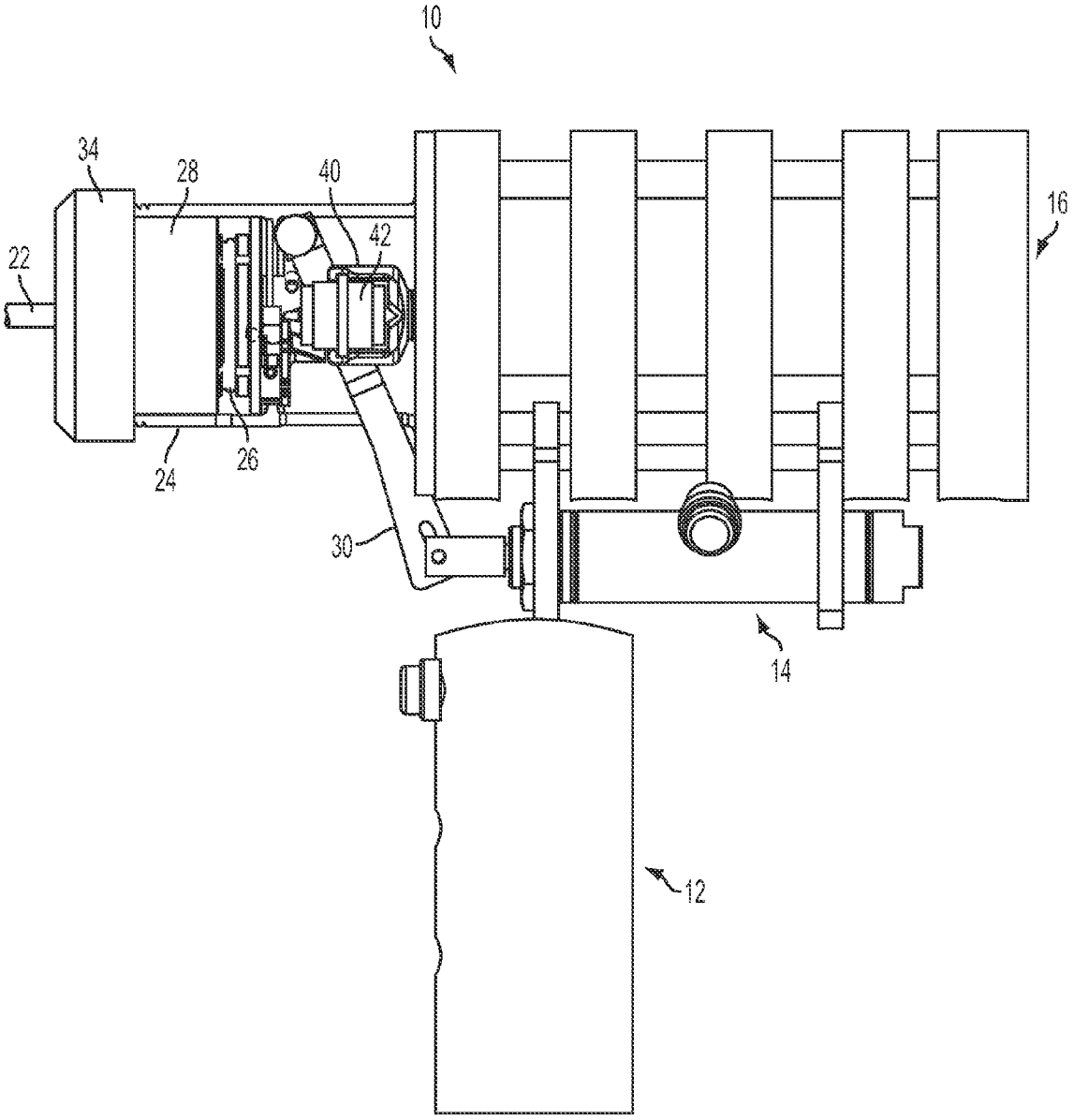
FIG. 6 is another side elevation and partial sectional view of the flaring tool of FIG. 3.
Figure 7:
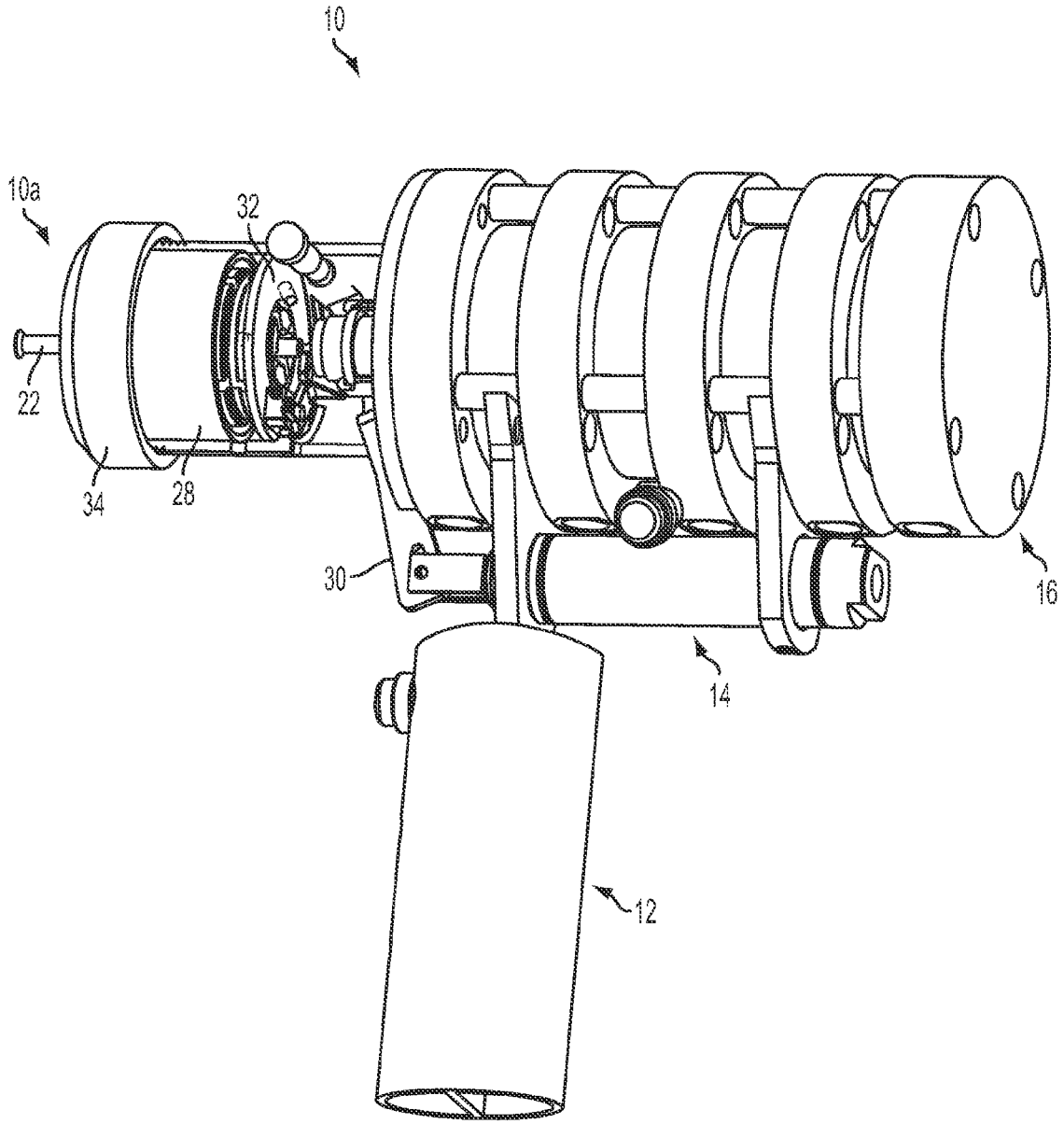
FIG. 7 is a perspective view of the flaring tool of FIG. 6.
Figure 8:
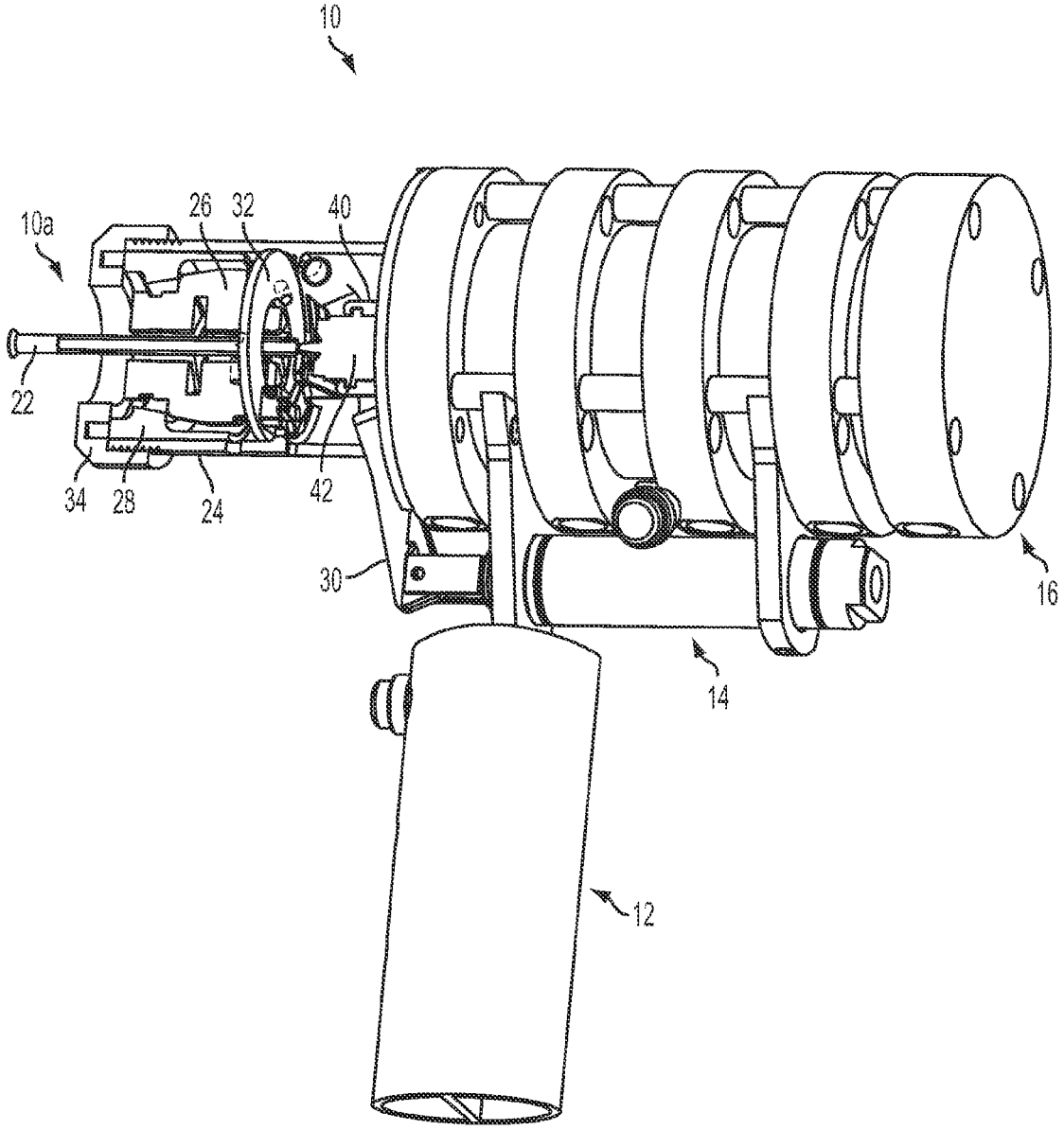
FIG. 8 is a another perspective view and partial sectional view of the flaring tool of FIG. 7.

As can be seen in FIG. 4, collet moving element 30 is pivotally mounted at housing 24 (with the housing partially removed in FIG. 4 to show additional details of the components within the housing) and is pivoted via extension of retraction of rod 14*b* of locking actuator 14. Collet moving element 30 includes a pair of arms or tabs 30*a* that extend from respective lever portions 30*b* (pivotally attached at housing 24 at one end via pivot pin 30*c* and attached at the other end 30*d* to rod 14*b*) and that engage a ring or collet engaging element 32 disposed at an inner end of collet 26. Thus, as rod 14*b* is extended, lever portion 30*b* pivots to move arms 30*a* against ring 32 and to move ring 32 and collet 26 relative to collar 28, which is fixedly retained relative to housing 24.

As shown in FIGS. 5, 8, 12 and 13, collet 26 comprises a four piece collet assembly with each piece being movable relative to the others between an expanded or non-locking orientation (FIGS. 3-13) and a collapsed or locking orientation (FIGS. 14-18), where the collet pieces (with curved or arcuate inner surfaces 26*a* (FIGS. 10 and 22-24) corresponding to the curvature of the outer surface of the tube 22 for the given or selected size of the tube that is being flared by the flaring tool) engage and clamp against the outer surface of the tube or pipe 22. Optionally, an end cap 34 may be removable from housing 24 to facilitate changing of the collet 26 to provide a desired radius of curvature of the inner surfaces 26*a* for the selected tube that is being flared by the flaring tool. The end cap may be threaded onto the end of the housing to allow a user to remove the collet to replace the collet with a different size collet for flaring different diameter tubes (with the inner tube engaging surfaces of the different collets having a different radius of curvature for a selected or different diameter tube or pipe).

Figure 13:
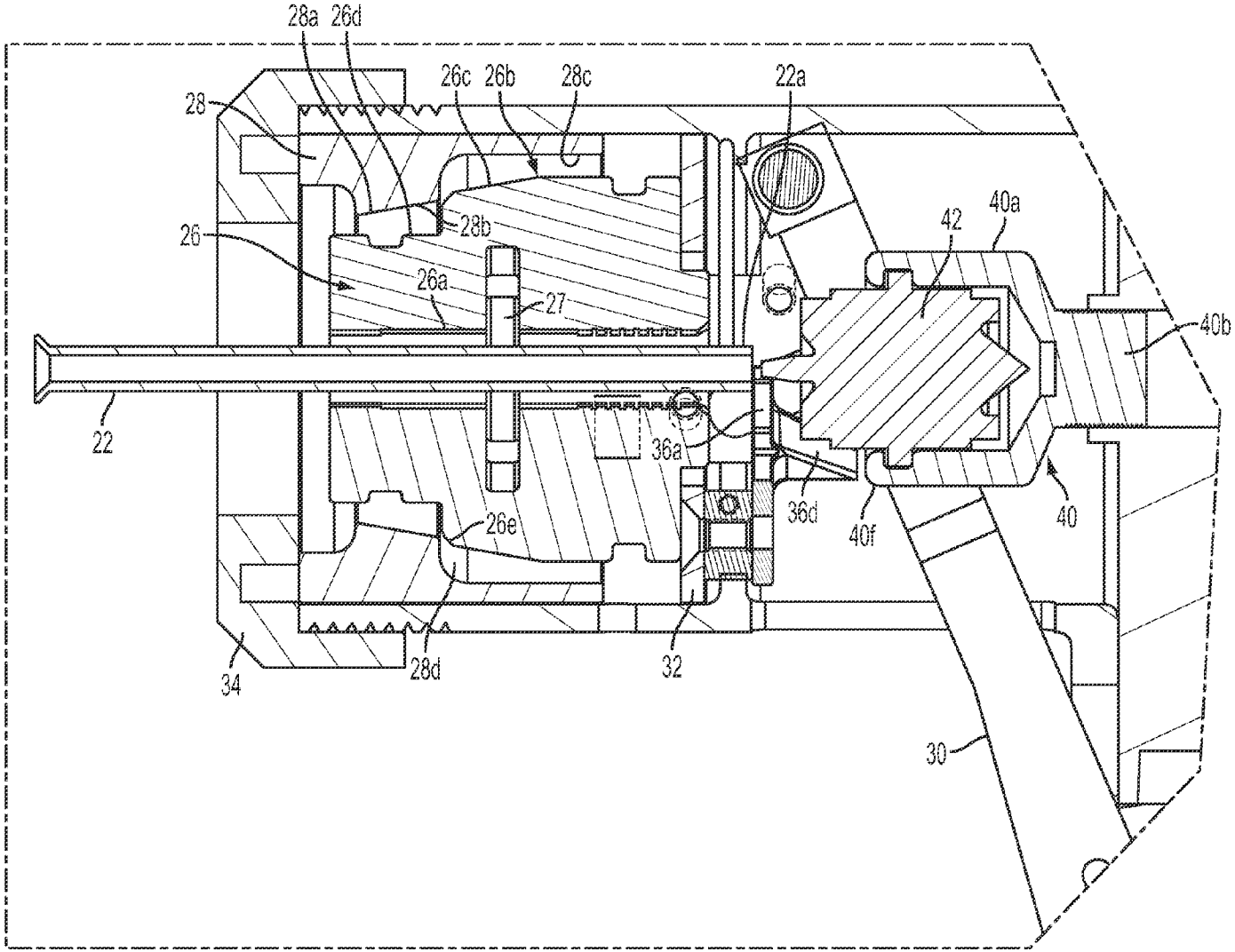
FIG. 13 is an enlarged sectional view of the flaring tool taken along the line A-A in FIG. 11.
Figure 14:
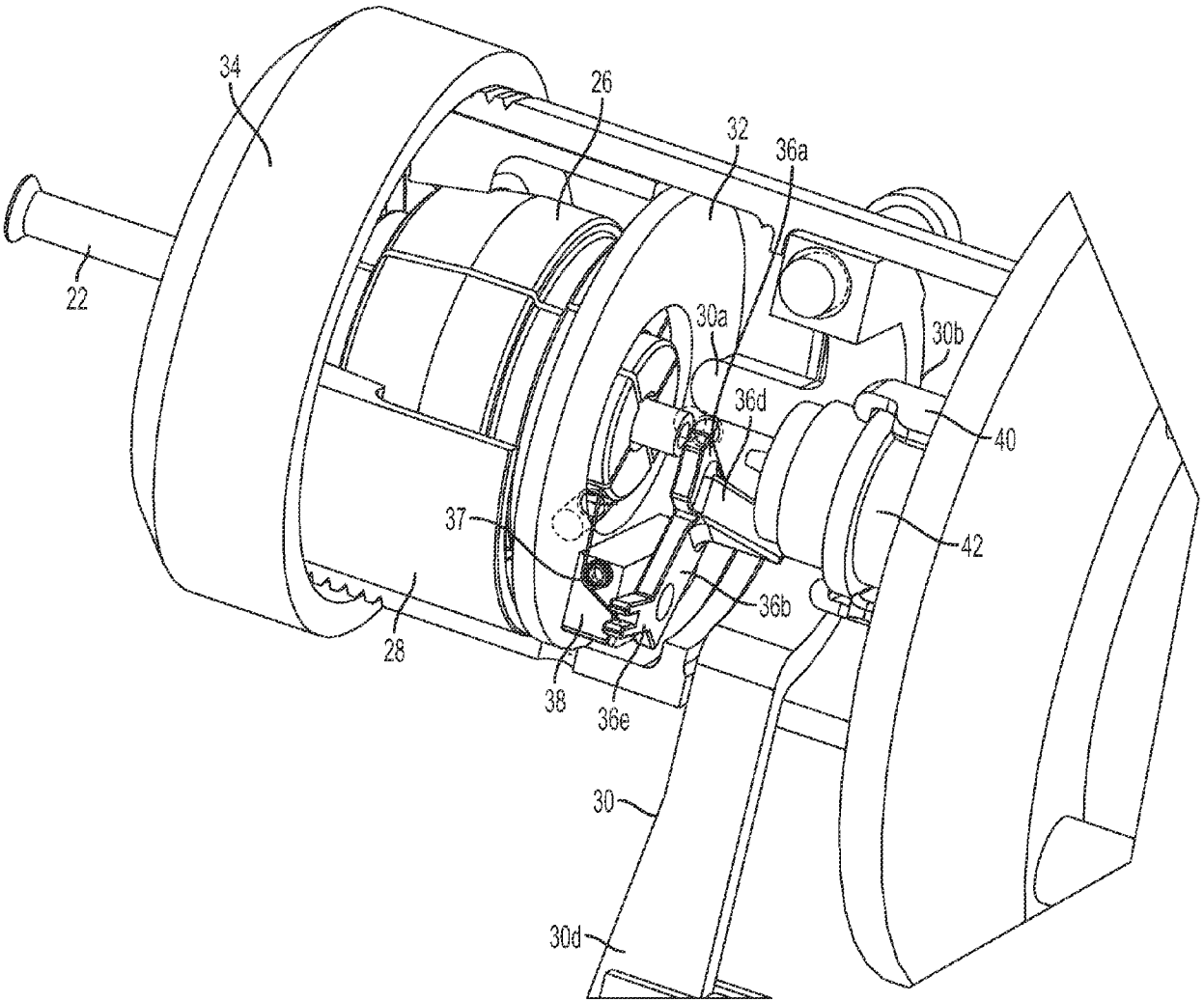
FIG. 14 is a perspective view of the collet and locking mechanism of the flaring tool of the present invention, shown with the collet locked onto the tube and with the flaring mandrel not in the flaring position.
Figure 15:
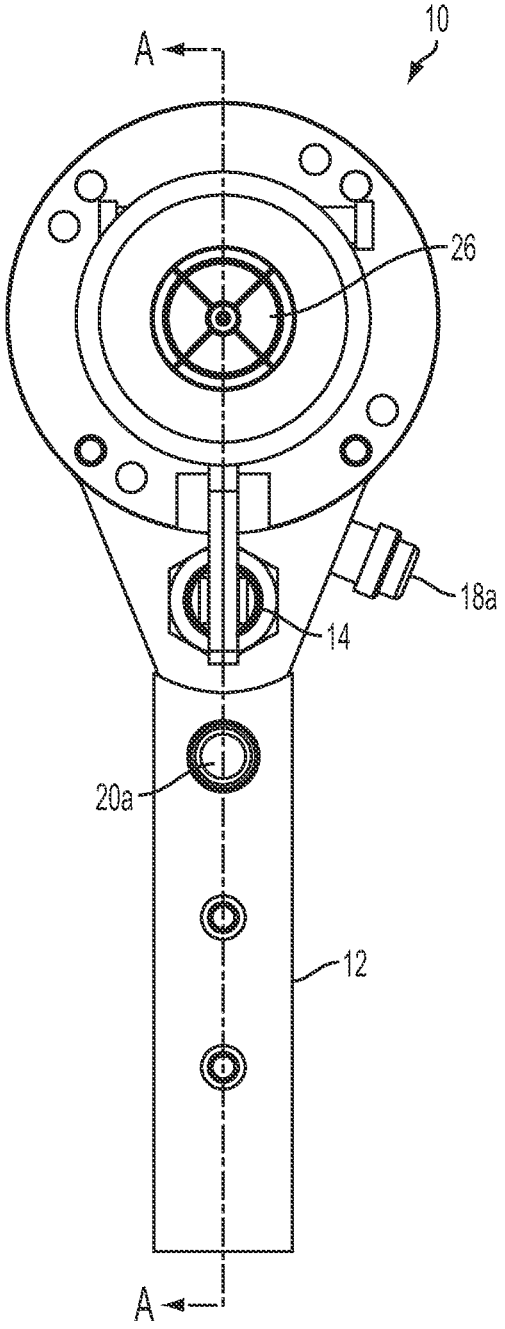
FIG. 15 is an end elevation of the flaring tool of the present invention, shown with the collet locked onto the tube.
Figure 16:
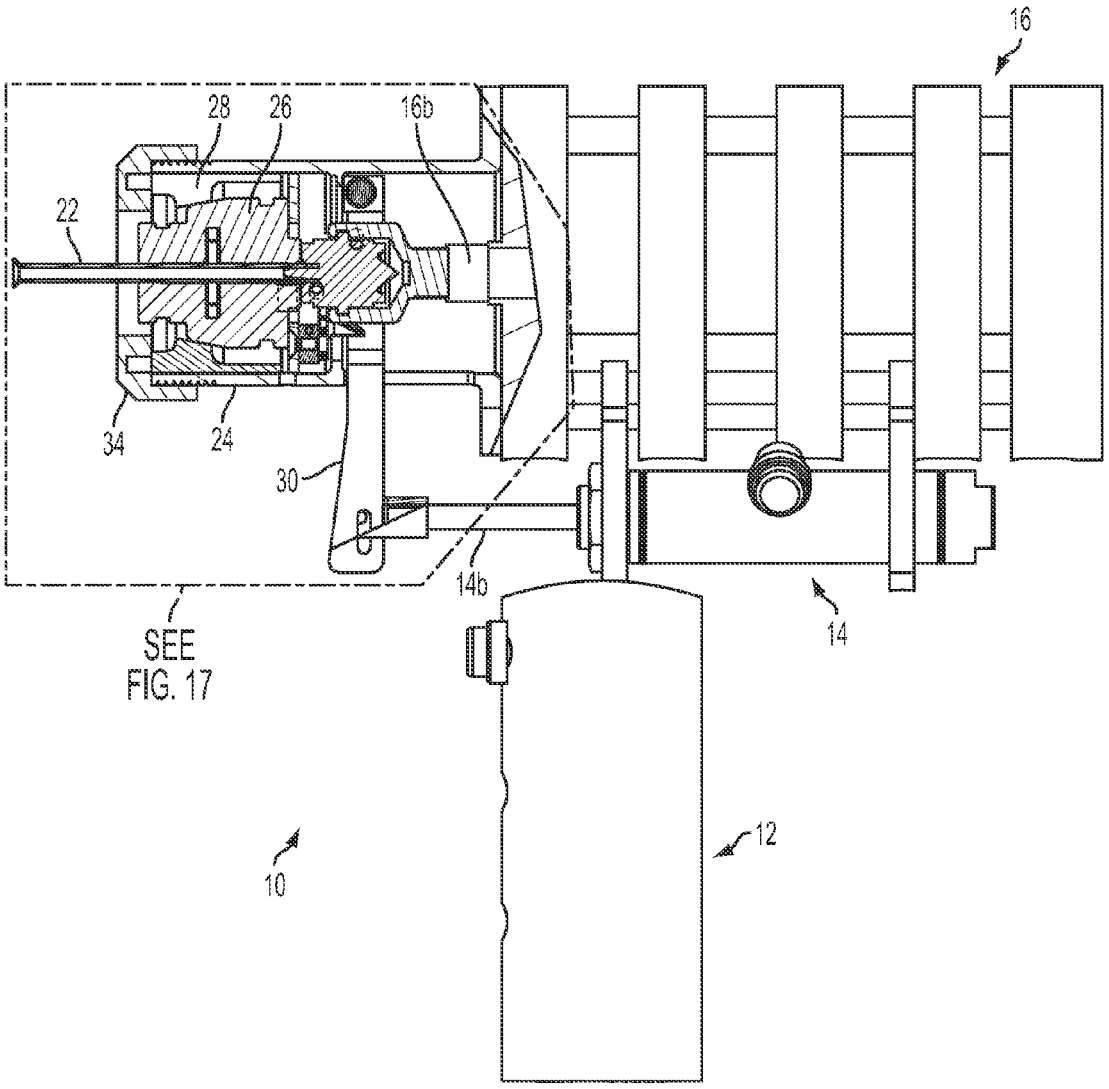
FIG. 16 is a side elevation and partial sectional view of the flaring tool taken along the line A-A in FIG. 15, shown with the flaring mandrel in its flaring position.
Figure 17:
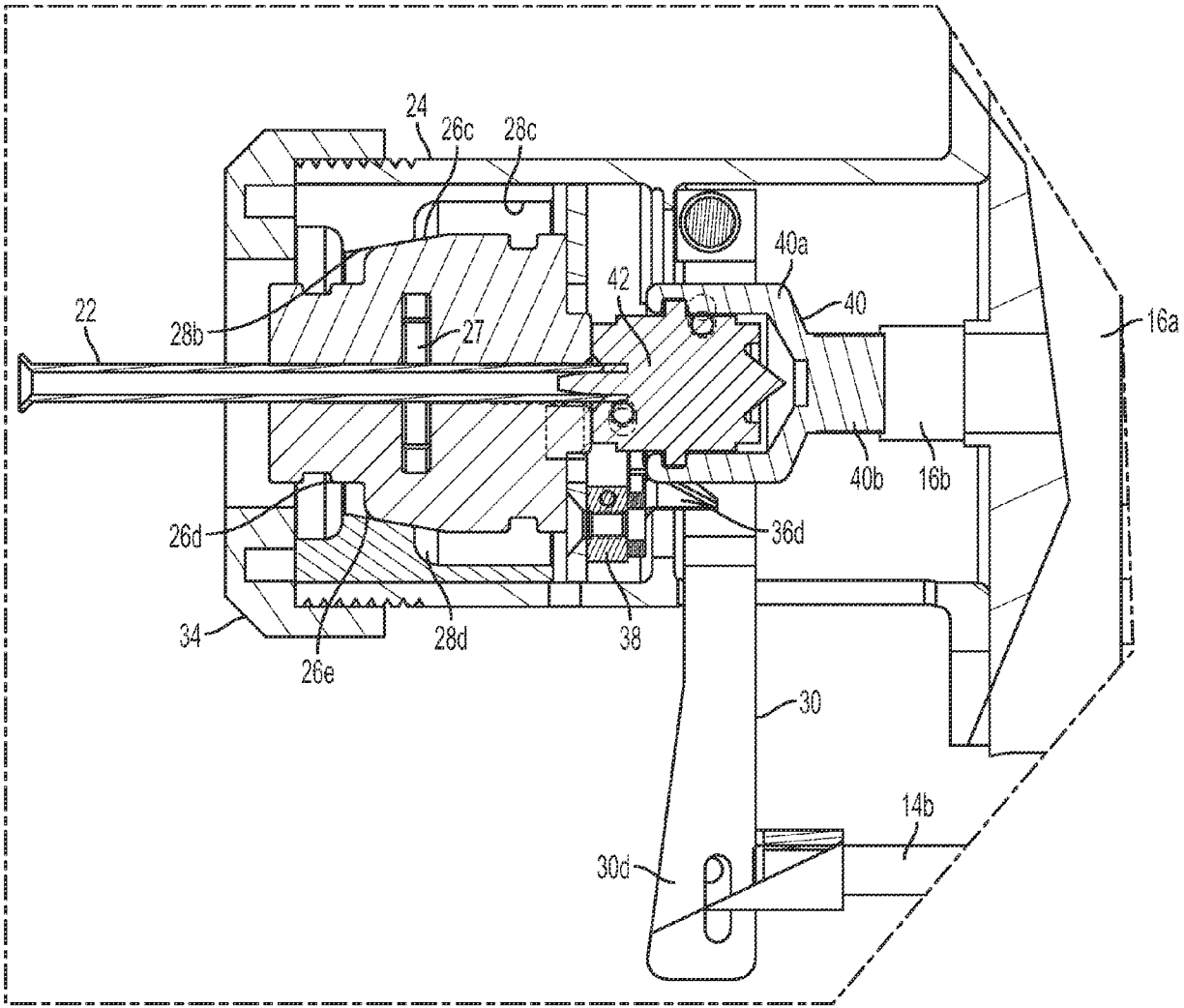
FIG. 17 is an enlarged sectional view of the flaring tool taken along the line A-A in FIG. 15.
Figure 18:
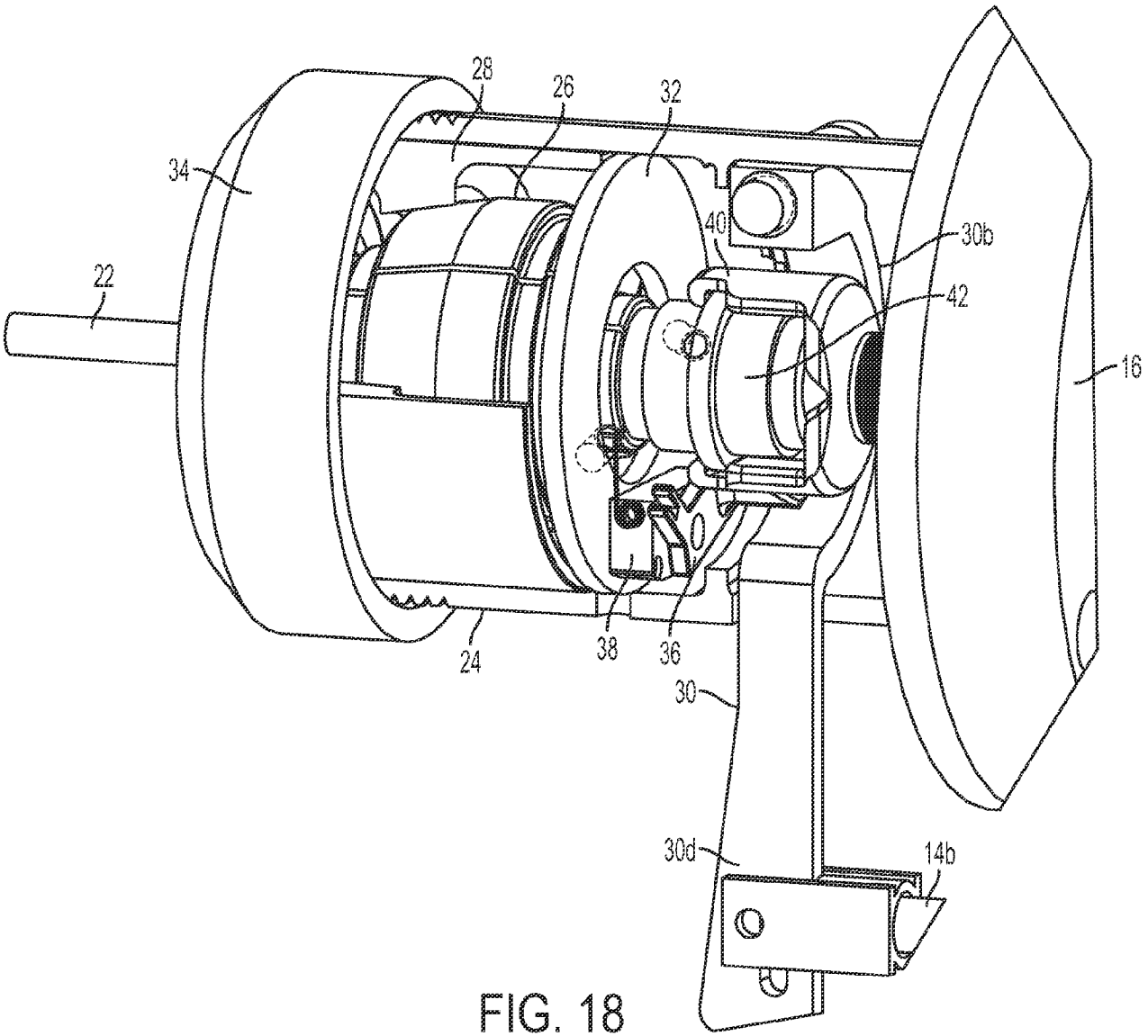
FIG. 18 is a perspective view of the collet and locking mechanism of FIGS. 15 and 16.
Figure 19:
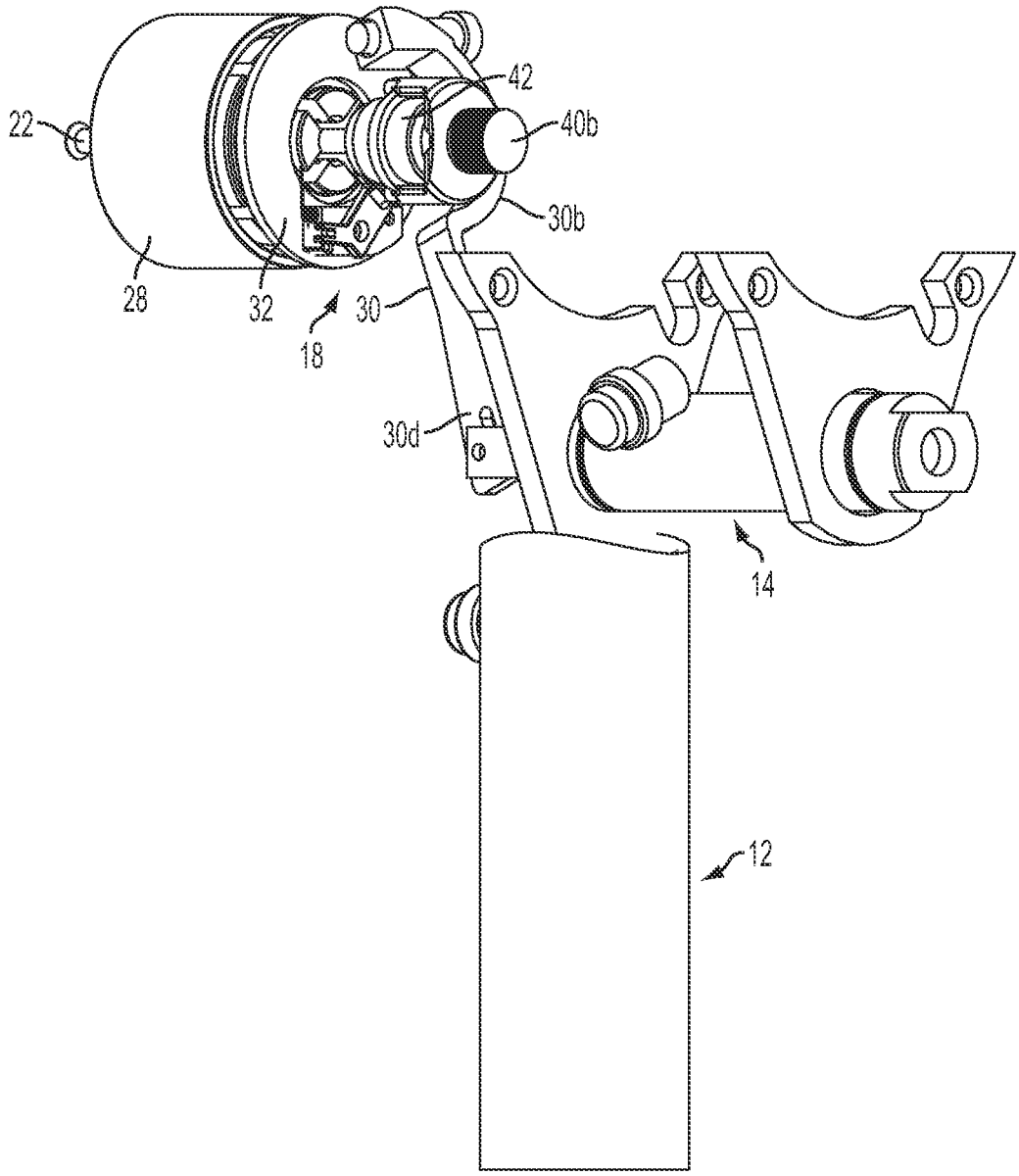
FIGS. 19-21 are perspective view of portions of the flaring tool of the present invention.
Figure 20:
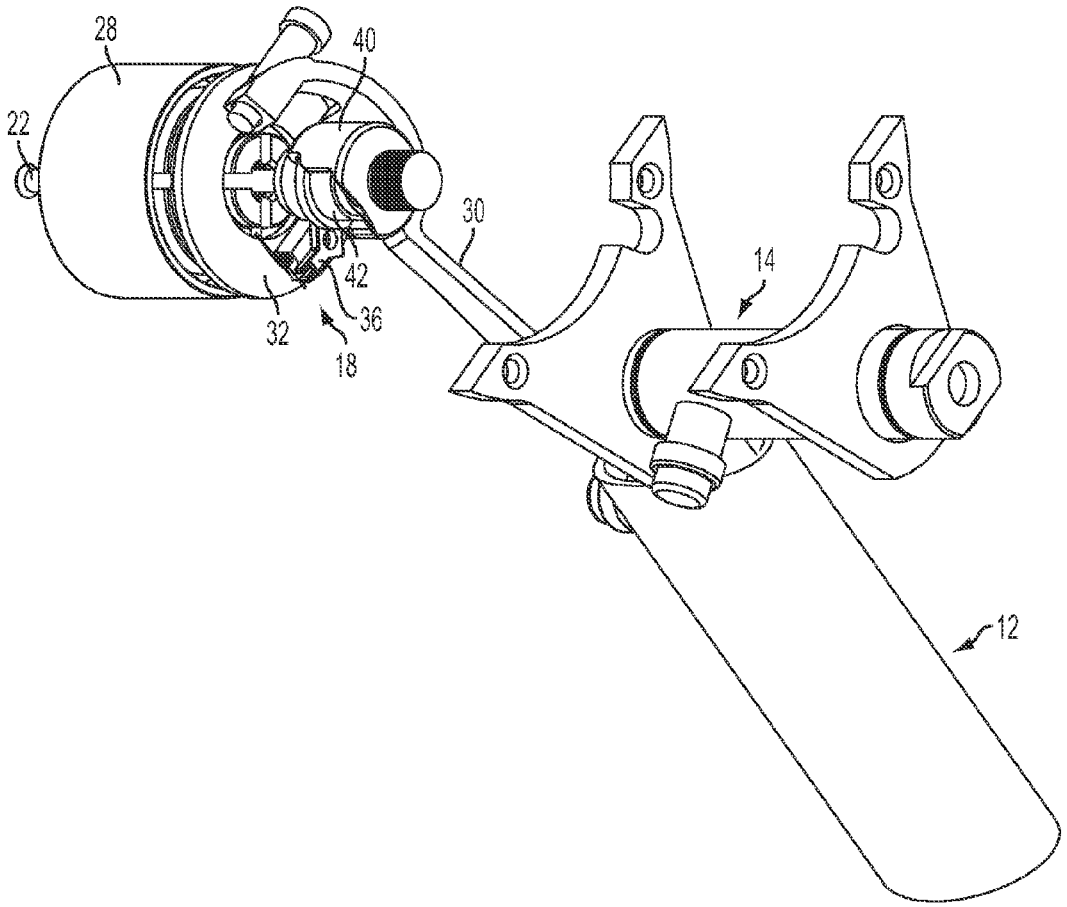
Figure 21:
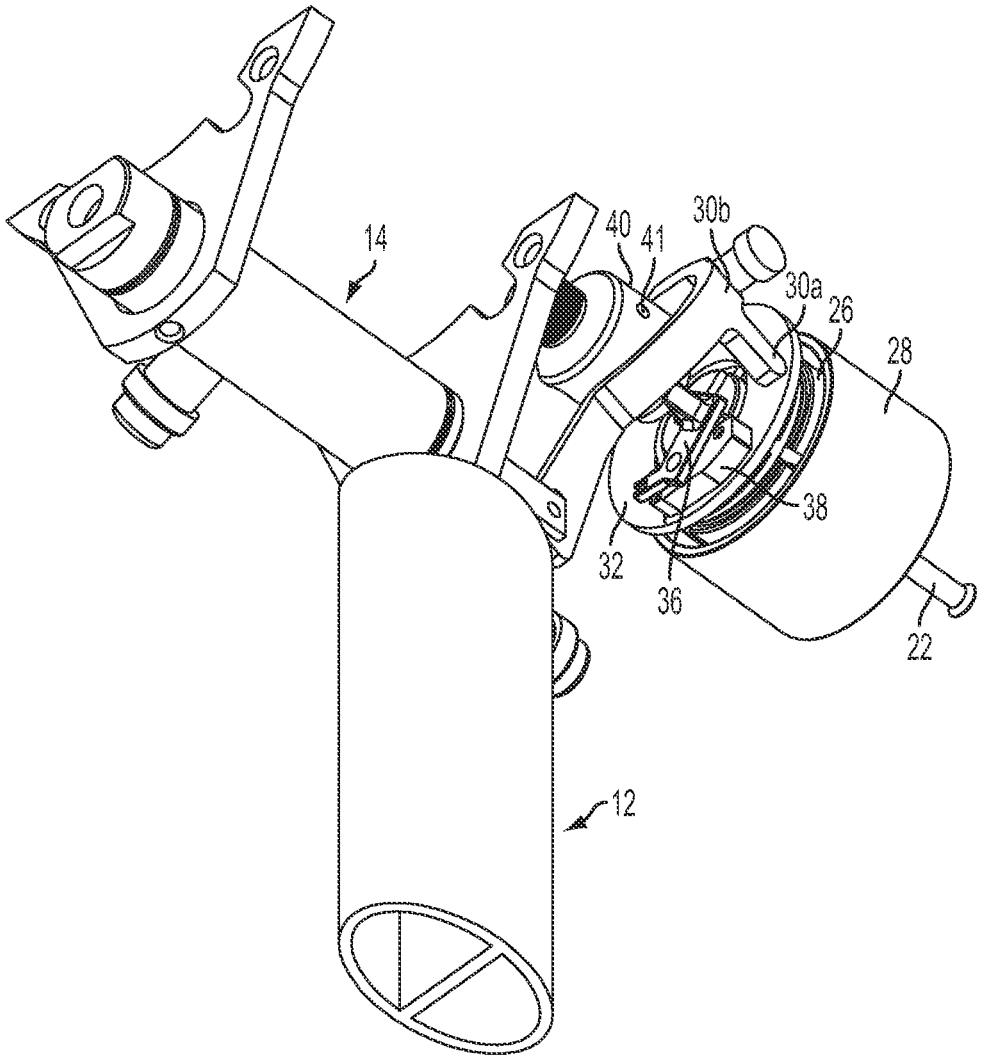
Figure 22:
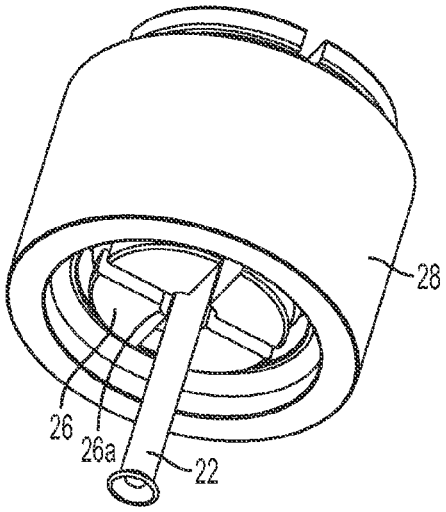
FIG. 22 is a perspective view of a collet and collar mechanism for locking the tube in the flaring tool of the present invention.
Figure 23:
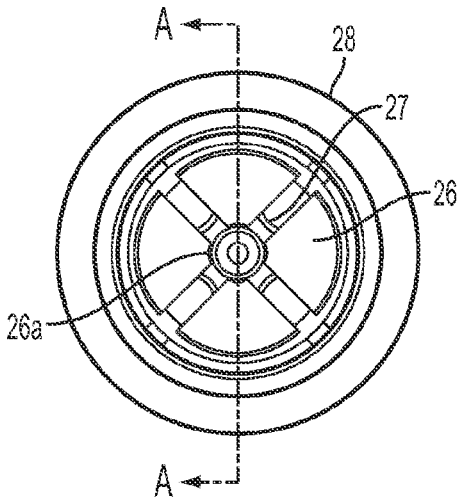
FIG. 23 is an end elevation of the collet and collar mechanism of FIG. 22.
Figure 24:
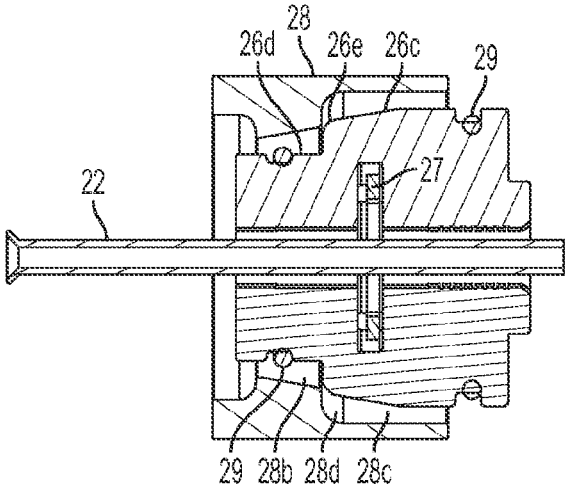
FIG. 24 is a sectional view of the collet and collar mechanism taken along the line A-A in FIG. 23.

As best shown with reference to FIGS. 13 and 17, collet 26 has a generally conical-shaped outer surface 26*b* that is moved into and along a generally conical-shaped inner surface 28*a* of collar 28, whereby, as the collet 26 is moved toward the outer, narrower end of the conical-shaped passageway of collar 28, the collet is urged towards its closed or clamping state to clamp against and around the tube 22. Optionally, and desirably, and as best shown in FIGS. 13 and 17, the outer surface 26*b* of collet 26 is stepped so that there is a larger, generally conical-shaped portion 26*c* and a smaller diameter portion 26*d*, while the inner surface 28*a* of collar 28 likewise has a smaller diameter conical surface portion 28*b* and a larger diameter portion 28*c*. In the illustrated embodiment, inner surface 28*a* of collar 28 includes a curved transition portion 28*d* between conical inner surface 28*b* and larger diameter inner surface 28*c*, while the outer surface 26*b* of collet includes a curved transition portion 26*e* between conical surface portion 26*c* and a smaller diameter portion 26*d*, in order to ease the insertion or movement of collet 26 into the conical inner surface portion of collar 28 when the locking mechanism is actuated.

The collet and collar constructions allow the smaller diameter conical surface portion 28*b* of collar 28 to engage and slide along the conical shaped portion 26*c* of collet 26 as collet 26 is urged into and along collar 28 by actuating lever 30 and ring 32, thereby urging collet 26 to its collapsed or clamping state (FIG. 17). When the locking mechanism is retracted, collet 26 is urged along the collar in the opposite direction and, when the conical outer surface 26*c* clears the conical inner surface 28*b* of collar 28 (and is disposed at the larger diameter inner surface portion 28*c*), the collet is free to expand to its non-compressed or non-clamping state (as shown in FIG. 13). The collar 28 is generally fixed relative to housing 24 and may engage the inner surface or wall of housing 24 and the end cap 34 when the end cap 34 is threaded onto or otherwise attached at the end of the housing 24, while the collet 26 may be moved relative to the collar to collapse the collet and clamp onto an inserted tube or to allow the collet to expand to release a tube or to be configured to receive a tube. Optionally, the collar and collet may be reversed, such that the collar may be moved (via actuation of the locking actuator and movement of the lever arm) onto and around the collet to clamp the collet onto the tube via movement of the lever or arm 30. However, the illustrated configuration is preferred because if the tube tends to move during the flaring process (responsive to the forces exerted at its held end), the movement of the tube would be in a direction that would urge the collet further into the collar and thus would increase the clamping force onto the tube by the collet, thereby further limiting or substantially precluding such tube movement. Optionally, the inner surfaces 26*a* of the collet 26 may include a roughened or knurled portion to further enhance gripping of the tube 22 to further limit or substantially preclude movement of the tube within the collet when the collet is clamped onto the tube.

Figure 25:
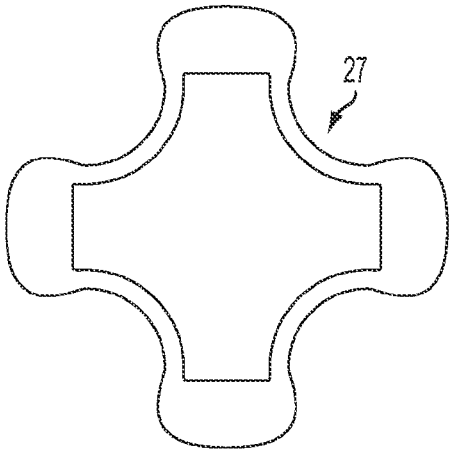
FIGS. 25-27 are perspective views of biasing elements suitable for use with the collet of the flaring tool of the present invention.
Figure 26:
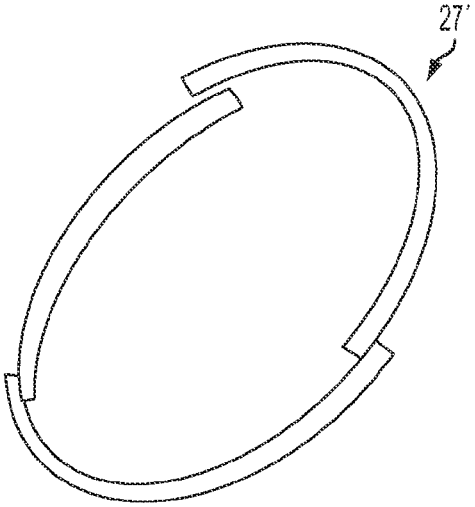
Figure 27:
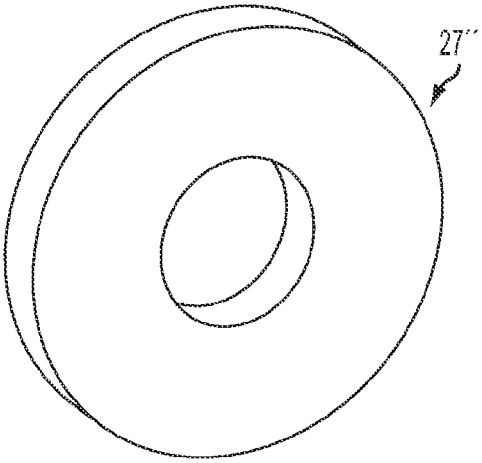

Collet 26 includes at least one biasing element 27 disposed within the collet portions. In the illustrated embodiment, each of the collet portions has a slot or groove established therein for receiving a respective portion of the biasing element 27. The biasing element 27 may comprise any suitable element or material that functions to exert a radially outward force at the collet portions so that the collet portion may expand when moved at least partially out of the collar 28 and that are sufficiently resilient or flexible to allow the collet to be collapsed onto the tube when the collet is moved into the collar 28. For example, and as shown in FIG. 25, biasing element 27 may comprise a flexible element (such as a metallic or elastomeric element) that is formed to allow for flexing as the collet is collapsed and that is biased towards its initial expanded state so as to exert a radially outward force to expand the collet. Other biasing elements may be utilized while remaining within the spirit and scope of the present invention. For example, the biasing element 27' (FIG. 26) may comprise a plurality of metallic ring portions disposed around the grooves of the collet portions or the biasing element 27" (FIG. 27) may comprise an elastomeric disc element (such as a flexible and compressible rubber material or the like), or any other suitable shape or material or element. Collet 26 also includes a pair of outer rings 29 disposed around the circumference of collet 26 at or near its ends (such as at the narrowed diameter portion 26*d* and at the inner end of collet outside of the conical surface 26*c* that engages inner conical surface 28*b* of collar 28 during compression of collet 26) to retain the collet portions together during expansion and compression of the collet 26. The outer rings 29 may comprise any resilient elastomeric rings or elements that allow for such expansion and compression of the collet during use of the flaring tool.

Locking mechanism 18 includes a stop element 36 that is movably disposed at ring element 32 and that is movable between a stopping position, where the stop element is disposed at least partially over or in front of the tube passageway through the collet 26 to limit insertion of the tube into the flaring tool 10, and a flaring position, where the stop element is moved from or remote from the tube passageway through the collet 26 to allow for the flaring mechanism 20 to engage and flare the end of the tube inserted through the tube passageway and secured or locked in place by the collet 26 and locking mechanism 18. The stop element 36 is biased to be urged or biased towards its stopping position (where it engages an end 22*a* of an inserted or received tube 22 and limits insertion of the tube at the locking mechanism of flaring tool 10), and is automatically moved away from the end of the tube 22 when the flaring mechanism is actuated to flare the end of the tube.

Figure 9:
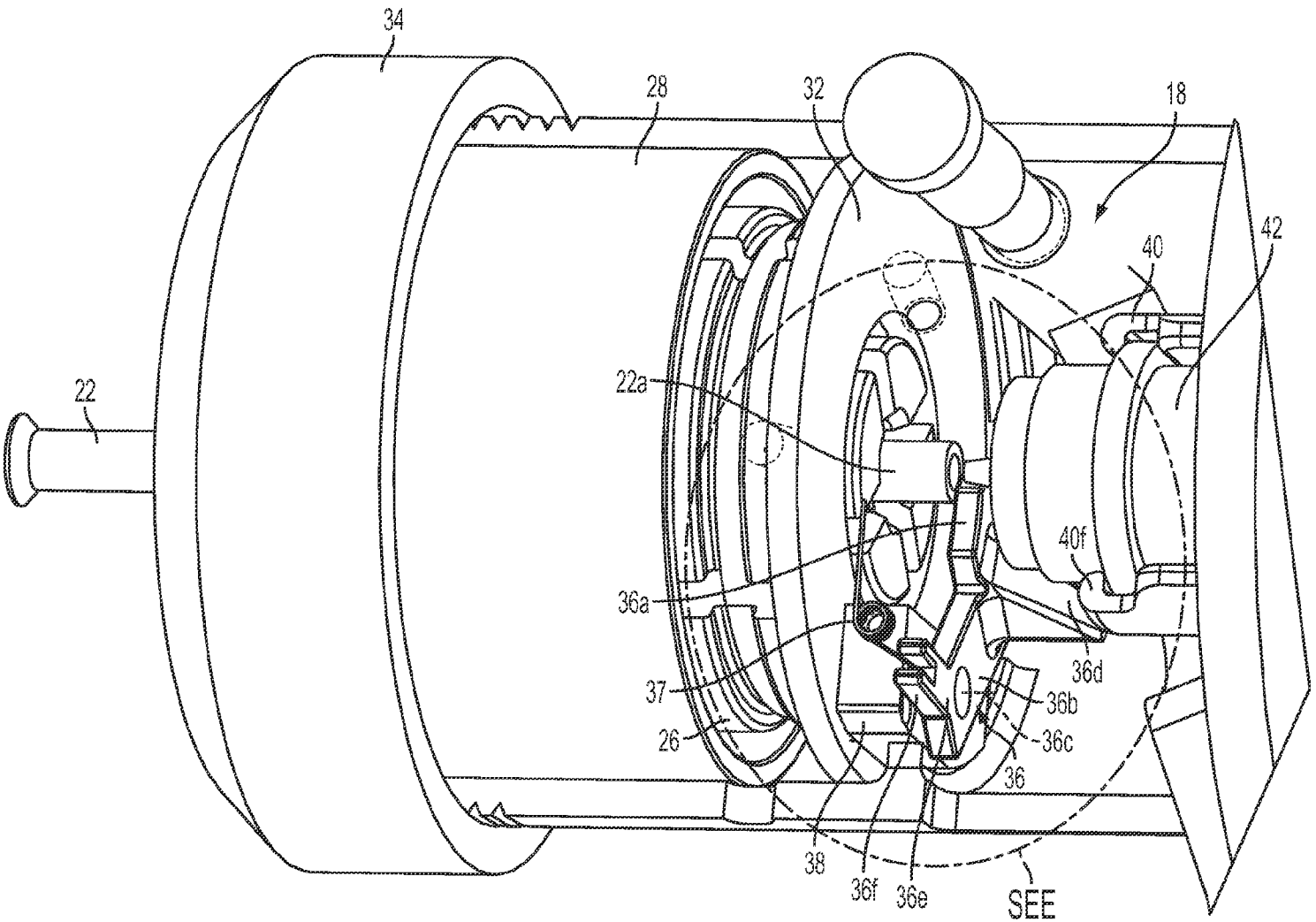
FIG. 9 is an enlarged perspective view of the collet and locking mechanism of the flaring tool of FIG. 6.
Figure 10:
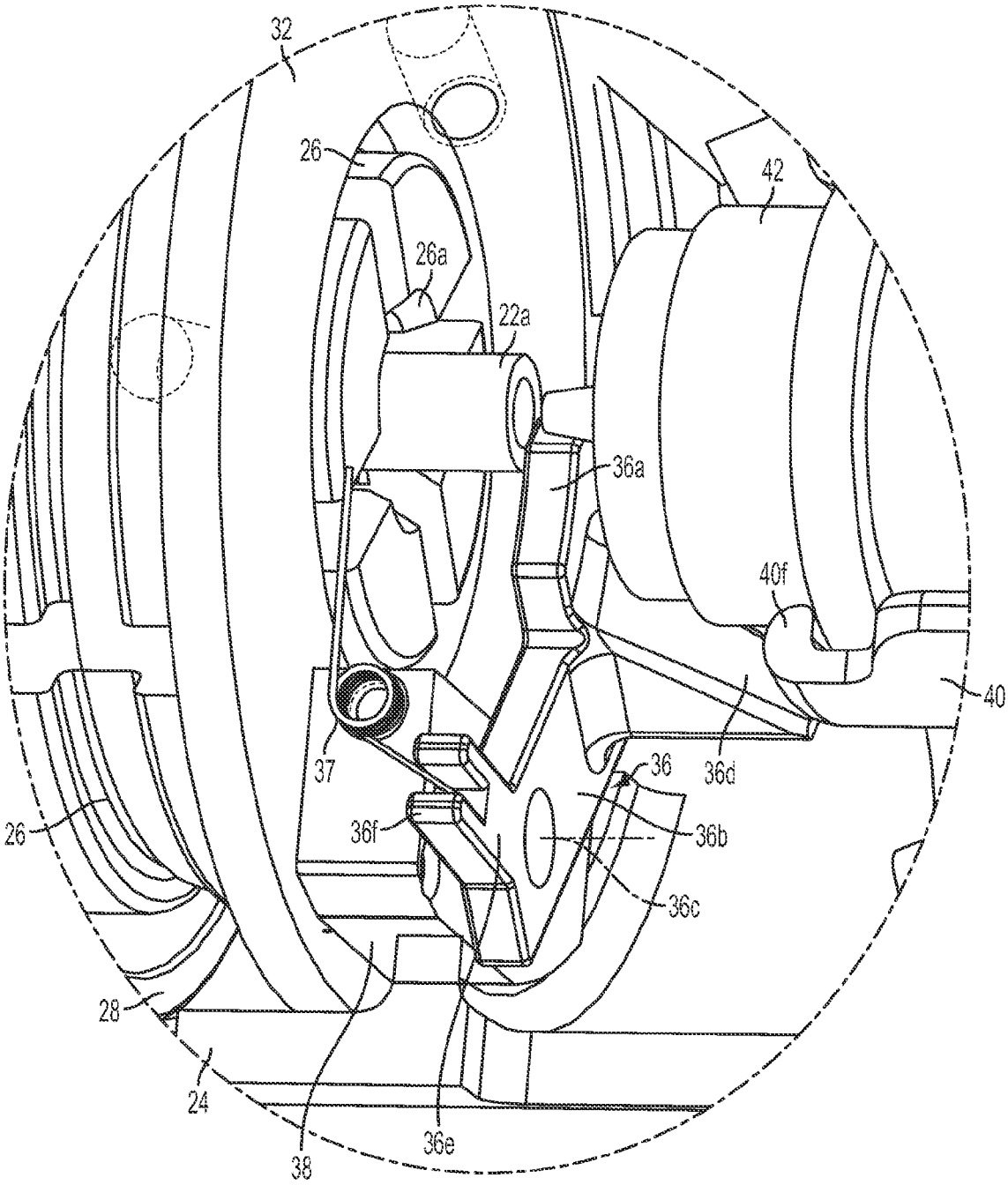
FIG. 10 is an enlarged perspective view of the locking mechanism of the flaring tool of FIG. 9.
Figure 11:
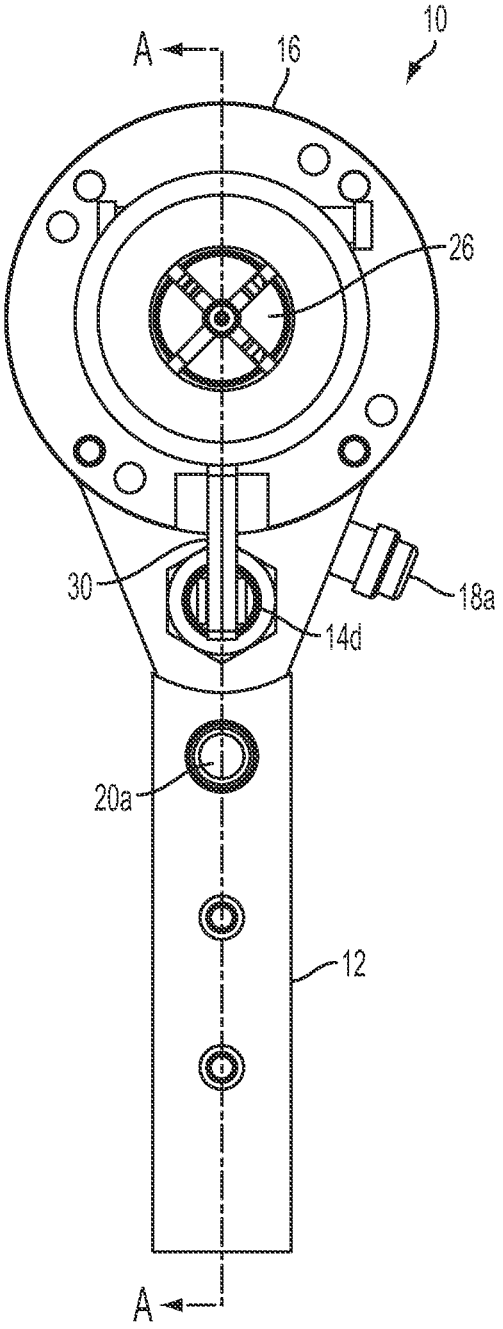
FIG. 11 is an end elevation of the flaring tool of FIG. 3.
Figure 12:
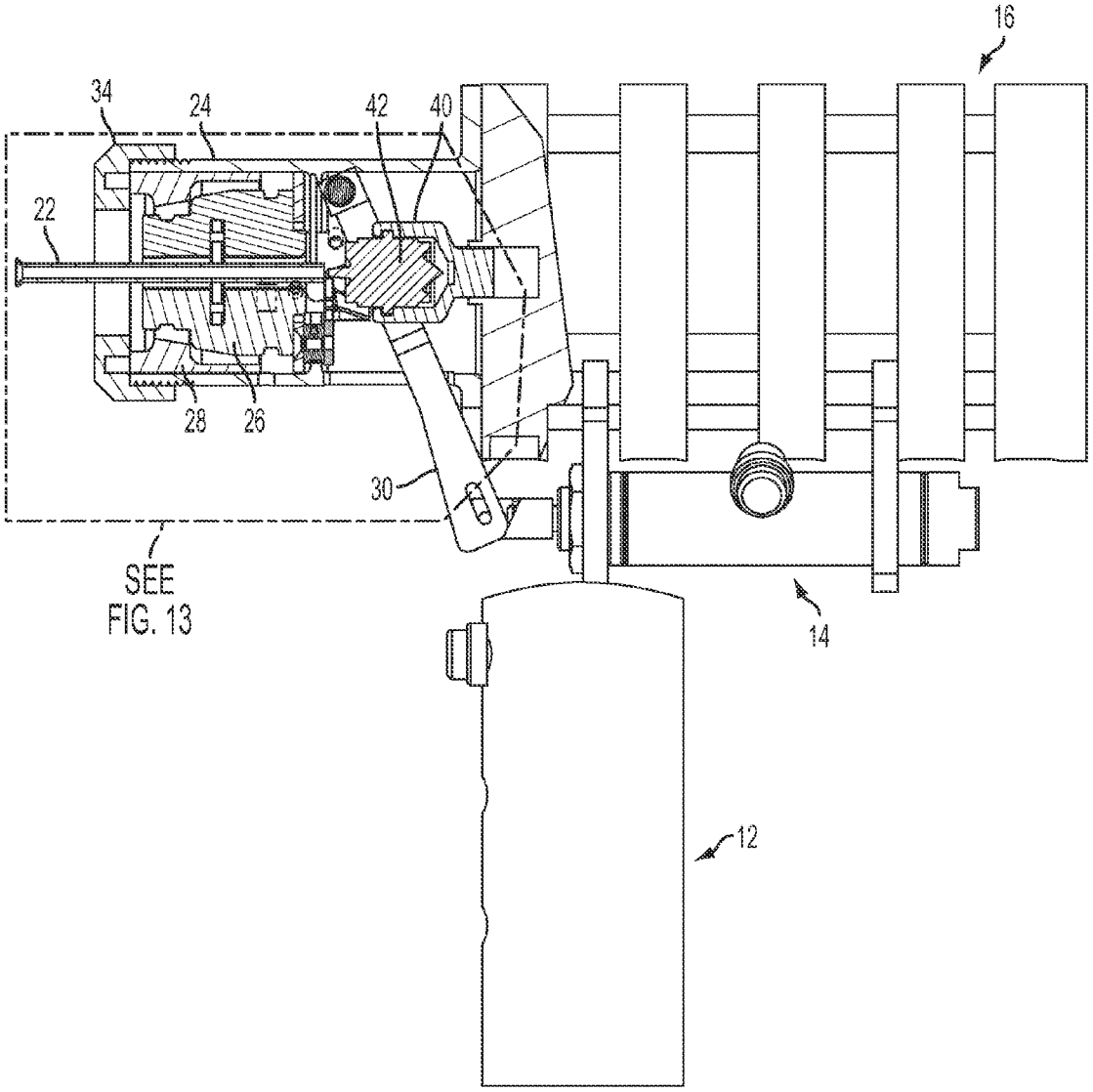
FIG. 12 is a side elevation and partial sectional view of the flaring tool taken along the line A-A in FIG. 11.

In the illustrated embodiment, stop element 36 is disposed at ring element 32 and is pivotally mounted to a spacer or mounting element 38 fixedly attached at ring element 32. The mounting element 38 is sized to space the stop portion 36*a* of stop element 36 (that is movable to overlay and engage a portion of the end 22*a* of the tube 22 when the tube is inserted into the tool and the stop element is in its stopping orientation) at the appropriate location relative to the collet so that the tube is automatically and repeatedly set at the desired or appropriate degree of insertion for flaring the end of the tube. As best shown in FIGS. 9 and 10, stop element 36 comprises a stop portion 36*a* that protrudes radially inward from an arm portion 36*b* that is pivotally mounted to mounting element 38 and is pivotable about a pivot axis 36*c*. Arm portion 36*b* has a ramp element 36*d* extending therefrom for engaging a portion of the flaring mechanism 20 so that as the flaring mechanism 20 (comprising a mandrel holder 40 and a flaring mandrel 42) is moved towards the end 22*a* of the tube 22, the mandrel holder 40 engages the ramp element 36*d* and urges or pivots arm portion 36*b* about its pivot axis 36*c* to move stop portion 36*a* away from the end of the tube 22.

As also shown in FIGS. 9 and 10, stop element 36 includes a biasing arm 36*e* extending in the opposite direction from pivot axis 36*c* as arm portion 36*b*, whereby a biasing element 37 (such as a torsional spring or the like) is mounted at mounting element 38 and engages a notched end 36*f* of biasing arm 36*e* to bias or urge biasing arm 36*e* radially outward and thus to bias or urge arm portion 36*b* and stop portion 36*a* radially inward toward the stopping position of stop element 36. Thus, when the flaring mechanism is actuated to flare the end of the held tube, the movement of the flaring mechanism towards the end of the held tube (held by the clamped or closed collet) causes the mandrel holder 40 to engage the ramp 36*d* of stop element to move the stop portion 36*a* to its non-stopping position away from the end of the tube so that the flaring mandrel 42 can engage the end of the tube and flare the tube. When the flaring operation is completed and the flaring mechanism is retracted, the biasing element 37 pivots the stop element 36 back to its stopping position so the stop portion 36*a* of stop element 36 is in the proper location for limiting insertion of the next tube or pipe that is inserted into the flaring tool.

Figure 28:
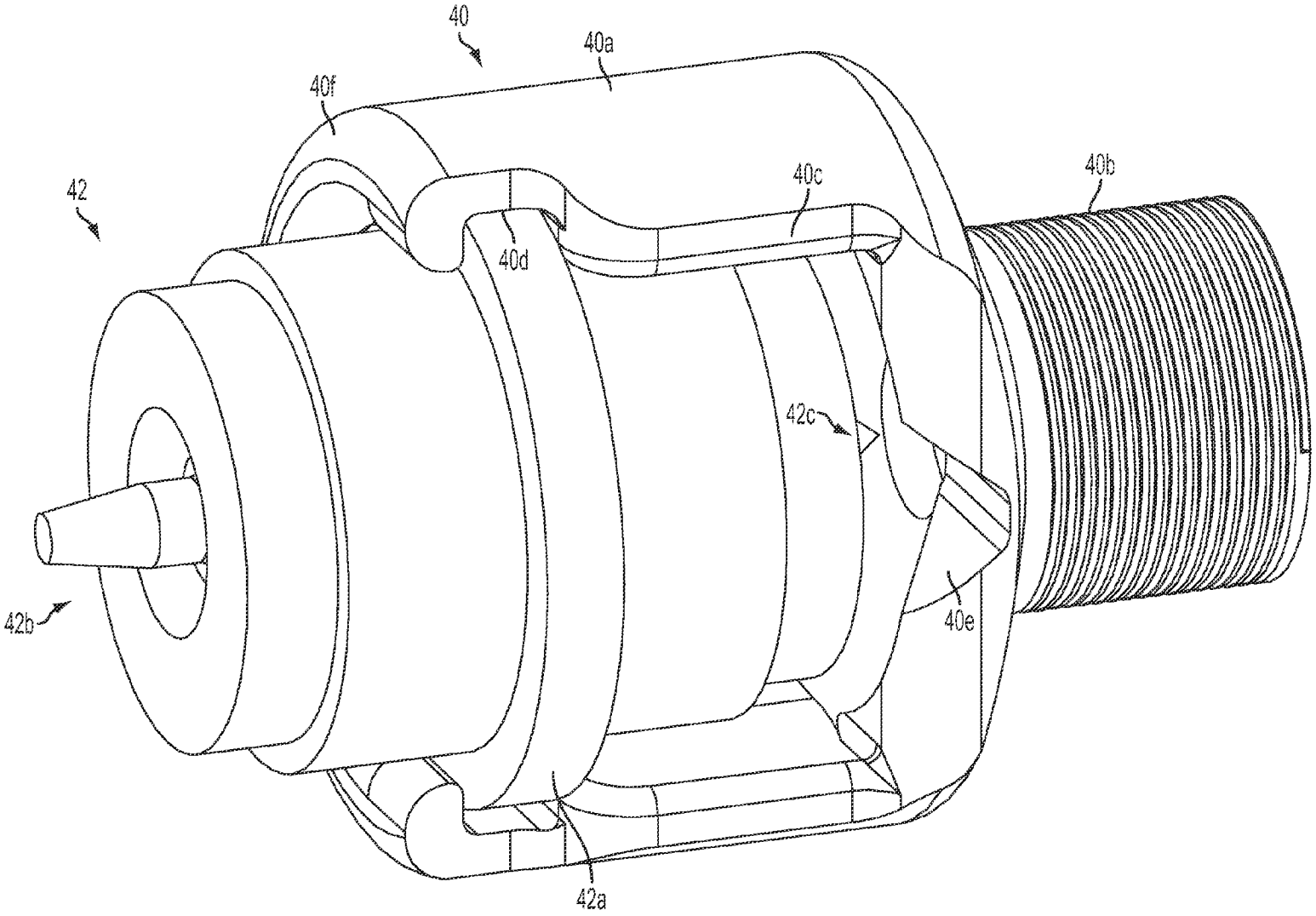
FIG. 28 is a perspective view of a reversible flaring mandrel and mandrel holder of the flaring tool of the present invention.
Figure 29:
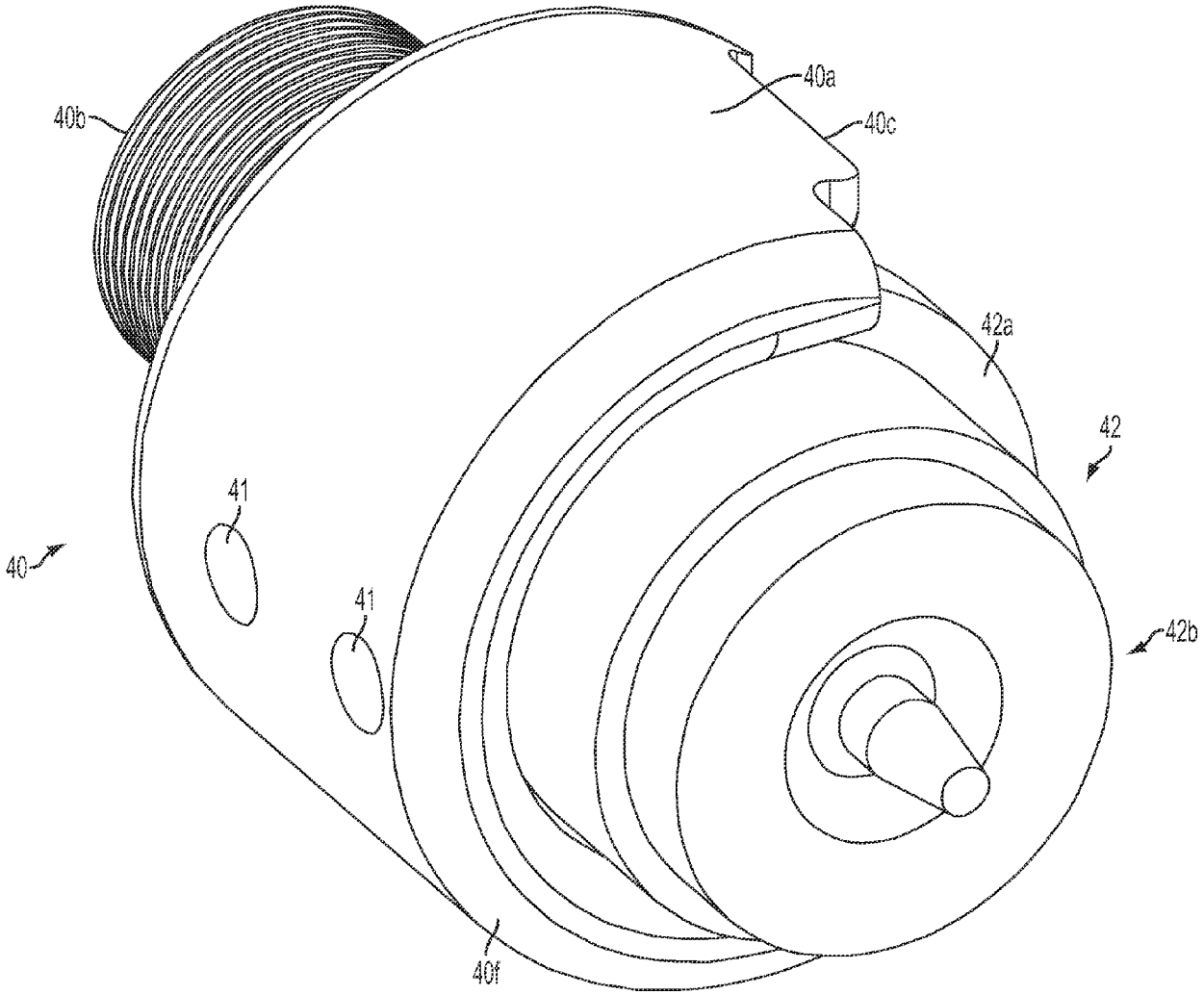
FIG. 29 is another perspective view of the reversible flaring mandrel and mandrel holder of the flaring tool of FIG. 28.
Figure 30:
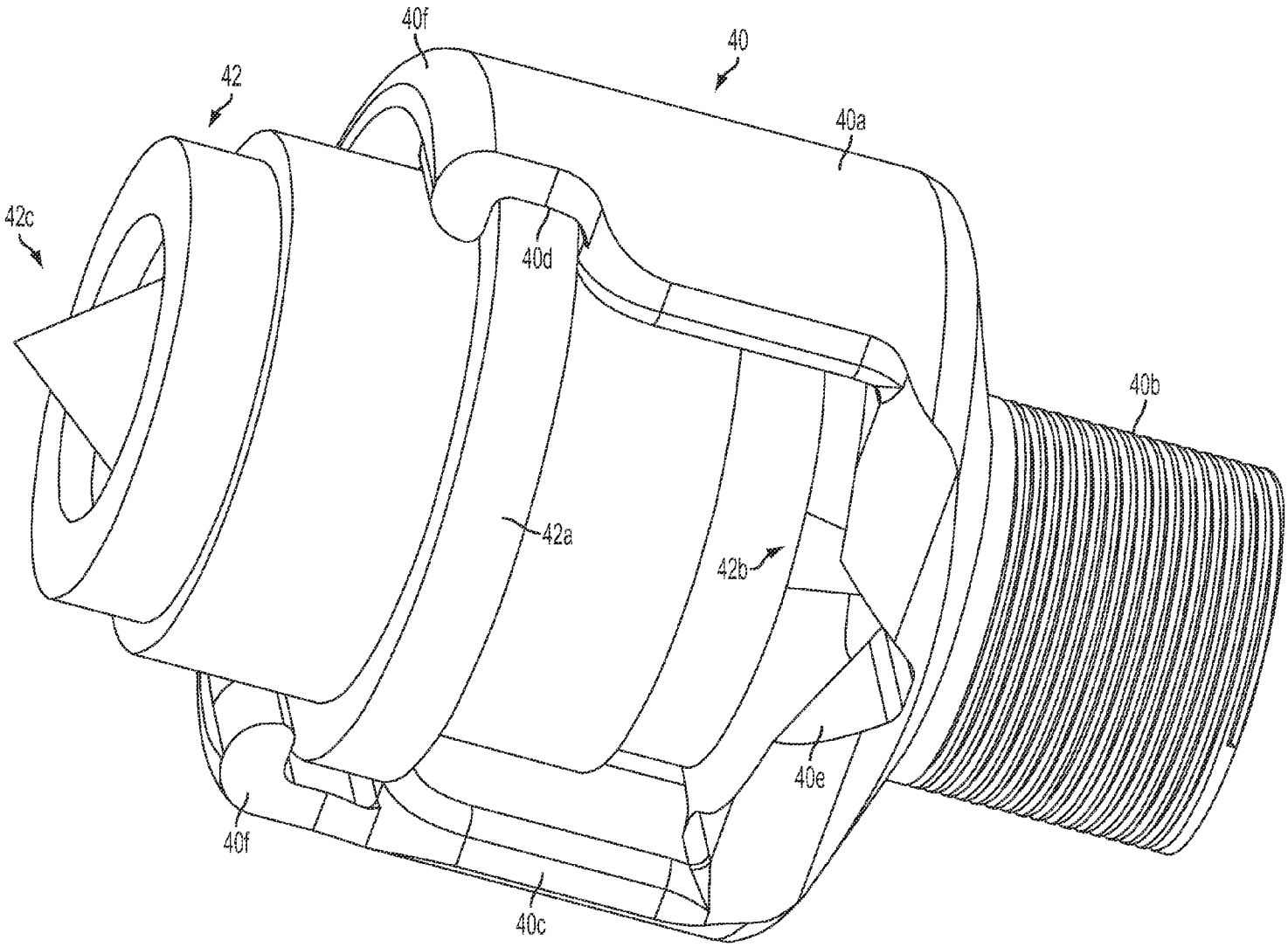
FIG. 30 is another perspective view of the reversible flaring mandrel and mandrel holder of the flaring tool of FIG. 28, shown with the mandrel reversed.

Flaring mechanism 20 includes the mandrel holder 40, which is attached to a movable or extendable and retractable rod or ram 16*b* of flaring actuator 16, which may comprise a pneumatic or hydraulic actuator or cylinder 16*a* that, responsive to a pressurized air of fluid input, extends and retracts the rod 16*b* to move the mandrel holder 40 between its retracted position (FIGS. 1-14) and its extended or flaring position (FIGS. 15-18). The mandrel holder 40 may be threaded onto an end of the rod 16*b* or may otherwise attach at the end of the rod 16*b* such that longitudinal movement of the rod (responsive to pressurized air or fluid at the cylinder 16*a*) moves the mandrel holder 40 and mandrel 42 along and within the housing 24. In the illustrated embodiment (and as best shown in FIGS. 13, 17 and 28-30), mandrel holder 40 comprises a mandrel receiving portion 40*a* and a mounting portion 40*b* for mounting (such as via threaded attachment) the mandrel holder 40 to the rod 16*b*. Mandrel receiving portion 40*a* comprises a generally cylindrical or partial cylindrical receiving element that partially receives mandrel 42 therein. As shown in FIG. 28, mandrel receiving portion 40*a* has a side opening or cutaway region 40*c* to allow for insertion and removal of the mandrel. The mandrel receiving portion 40*a* has a retaining groove 40*d* at its inner surface for receiving a retaining lip or flange 42*a* of mandrel 42 to limit longitudinal movement of mandrel 42 relative to mandrel holder 40 during the flaring process. As shown in FIG. 28, side opening 40*c* of mandrel holder 40 may have a notch 40*e* at or near mounting portion 40*b* to allow for clearance of the flaring end of mandrel 42 during removal and insertion of the mandrel at the mandrel holder. Optionally, and desirably (and as shown in FIG. 29), mandrel holder 40 may include one or more retaining elements 41 (such as magnets or magnetic elements or the like) at a side region of mandrel receiving portion 40*a* opposite to side opening 40*c* to magnetically attract the metallic mandrel 42 and thus to limit retraction of mandrel 42 from mandrel holder 40.

As shown in FIGS. 1 and 2, housing 24 has a side opening or window 24*a*, which is generally aligned with mandrel 42 when mandrel holder 40 is in its retracted position, and which allows a user to remove the mandrel 42 from the mandrel holder 40, such as for replacing the mandrel with a new mandrel or a different size or shape mandrel or the like. Thus, between flaring operations, a user may readily remove the mandrel without having to disassemble the flaring tool. Optionally, mandrel 42 may comprise a reversible mandrel, with a bubble flare end 42*b* and a conical flare end 42*c*, such that a user may first perform a bubble flare on a tube held in the flaring tool, then remove and reverse the mandrel 42 and perform a conical flare at the end of the held tube, all while the tube is securely retained at the appropriate location for the flaring processes and all with the same hand held flaring tool.

Thus, a user of flaring tool 10 may hold flaring tool 10 at handle portion 12 and insert an end of a tube or pipe 22 into the receiving end or portion 10*a* of the flaring tool 10 and into the collet 26 until the end 22*a* of the tube 22 contacts stop portion 36*a* of stop element 36 (which is biased towards its stopping orientation), whereby further insertion of the tube is limited or substantially precluded by stop element 36. When the tube is so inserted (and is set to the desired position for flaring), the user may actuate the locking actuator 14 (such as via pressing or actuating user input 18*a*) to cause locking actuator 14 to extend rod 14*b* (responsive to pressurized air or fluid at cylinder 14*a*) to pivot lever portions 30*b* of collet moving mechanism 30 and to urge arms 30*a* toward the receiving end of the tool to move ring 32 and collet 26 relative to collar 28 and housing 24 (and moving the stop element 36 and the tube 22 as well) to cause collet 26 to collapse and clamp onto the tube 22 to securely retain the tube 22 in collet 26 and housing 24 (with the end of the tube being at the desired or appropriate location for flaring).

After the tube is secured at the flaring tool 10, the user may actuate the flaring mechanism 20 (such as via pressing or actuating user input 20*a*) to cause flaring actuator 16 to extend rod 16*b* (responsive to pressurized air or fluid at cylinder 16*a*) to move mandrel holder 40 and mandrel 42 towards and into engagement with the end of the tube 22. As the mandrel holder 40 is moved towards the end of the tube, the forward lip 40*f* of mandrel holder 40 (which may be rounded or curved to facilitate sliding movement of the lip 40*f* relative to the ramp 36*d*) engages ramp 36*d* of stop element 36 and, as the forward lip 40*f* moves along the ramp 36*d*, stop element 36 pivots to move stop portion 36*a* away from the end of the tube 22. Further movement by mandrel holder 40 moves the flaring end (such as the bubble flaring end 42*b*) of mandrel 42 into engagement with the tube end 22*a* to flare the tube end 22*a*.

After the first flaring process is completed, the user may release the flaring user input 20*a* (or actuate a second user input or the like) to allow the mandrel holder 40 and mandrel 42 to retract so that mandrel 42 is located at or near window 24*a* of housing 24. The user may then remove mandrel 42 from mandrel holder 40 and may replace the mandrel or may flip the mandrel so that another flaring end (such as the conical flaring end 42*c*) of mandrel 42 is disposed at the mandrel holder for engaging the tube end 22*a*. The user may then again actuate the user input 20*a* to cause the mandrel holder 40 and mandrel 42 to again move towards the tube end and to cause the mandrel 42 to again engage the tube end to flare the tube end in the desired manner (while again engaging the ramp 36*d* and pivoting the stop portion 36*a* away from the tube end). When the second flaring process is completed, the user input 20*a* may be released (or another user input may be actuated) and the mandrel holder 40 and mandrel 42 are retracted. When the mandrel holder 40 is retracted, the forward lip 42*f* is moved away from ramp 36*d* and the stop portion 36*a* of stop element 36 is urged (responsive to biasing element 37) back to its initial stop position at or near the end of the tube. The locking mechanism 18 may then be released to allow for removal of the tube 22 from the collet 26 (with the collet 26 being allowed to substantially expand when its conical portion 26*c* is moved to be within the larger diameter inner surface 28*c* of the collar 28 to provide internal clearance within the collet for removal of the flared end of the tube.

The locking actuator 14 may comprise any suitable actuator, such as any suitable linear actuator or the like, without affecting the scope of the present invention. For example, the locking actuator 14 may comprise a pneumatic actuator or an electrical actuator that, responsive to pressurized air or fluid or responsive to an electrical input, functions to extend and retract a rod to impart a longitudinal movement of the collet relative to the collar.

Figure 31:
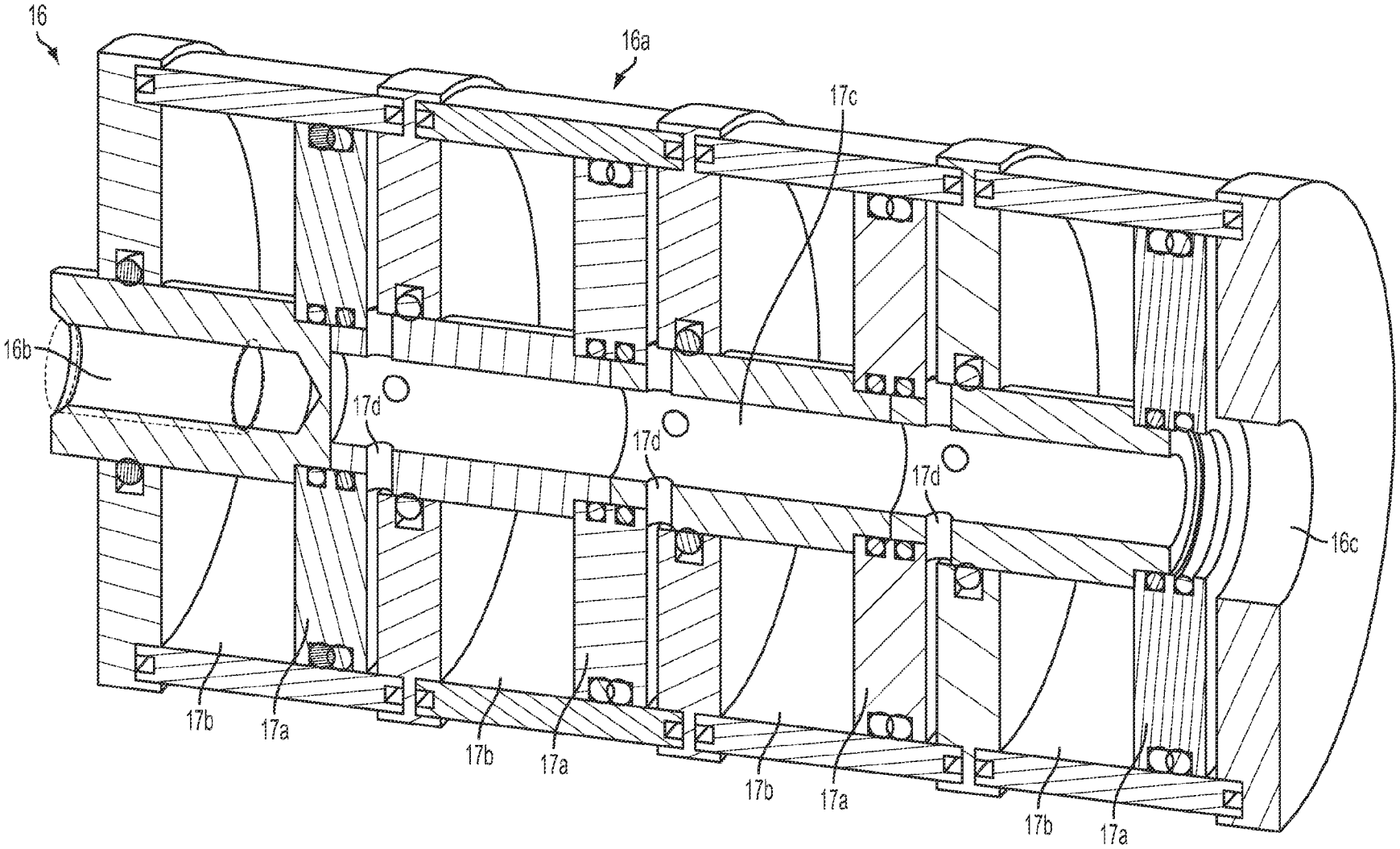
FIG. 31 is a sectional view of a multi-stage flaring cylinder of the flaring tool of the present invention.

Likewise, the flaring actuator 16 may comprise any suitable actuator, such as any suitable linear actuator or the like. For example, the flaring actuator 16 may comprise a pneumatic actuator or an electrical actuator that, responsive to pressurized air or fluid or responsive to an electrical input, functions to extend and retract a rod to impart a longitudinal movement of the mandrel holder and mandrel relative to the collapsed collet and held tube. Optionally, and with reference to FIG. 31, flaring actuator 16 may comprise a larger step up actuator or cylinder that uses multiple pistons at different diameters to increase the force applied by the output end of the cylinder (at the rod end and mandrel holder) in response to an air pressure at an input end of the cylinder. As shown in FIG. 31, the flaring actuator 16 may comprise a four stage actuator (or more or less stages), whereby an inward air pressure at an inlet end 16*c* may result in a substantially higher output force at the output end of the cylinder, due to the progressively increased output forces exerted by the series of pistons 17*a* in the series of chambers 17*b*. The actuator allows for higher forces to be slowly applied to the end of the tube via movement of rod 16*b* (responsive to pressurized air at the inlet end 16*c*, which passes into the multiple chambers 17*b* via a central passageway 17*c* and chamber ports 17*d*) in a controlled manner to flare the tube in a manner that limits or substantially precludes damage to the end of the tube during the flaring process.

Optionally, the flaring actuator may comprise any other suitable device or mechanism for driving a flaring rod towards and into engagement with the tube end to flare the tube end. For example, the flaring actuator may comprise a rotational driving means or device, such as a pneumatic driver or impact driver or the like, which may be incorporated in the tool and operable to rotatably drive a threaded rod of the tool to impart a longitudinal movement of the flaring mandrel in the desired or appropriate direction (such as to flare the tube end and to retract the mandrel from the flared tube end). Optionally, the flaring tool may include a threaded rod or the like that may be externally accessible and rotatably driven via a separate hand held rotary driving means, such as a pneumatic impact wrench or driver or the like, whereby rotational driving of the threaded rod causes the flaring end of the rod to be driven towards and into engagement with the tube end to flare the tube end, and rotational driving in the opposite direction backs the threaded rod away from the tube end. For example, the threaded actuating rod may be threadedly received through a housing portion of the flaring tool with one end of the rod engaging the mandrel (and rotatably engaging such that rotation of the rod does not impart a corresponding rotation of the mandrel) and with the other end of the rod comprising a fastener head, such as a hexagonal-shaped head or other non-circular head or a head with a recessed formed therein for receiving a star driver or allen wrench or the like. The threaded rod may be rotatably driven via a separate rotational driving tool or may be rotatably driven via a rotational driving tool incorporated in the flaring tool.

Thus, a user of the flaring tool may position the flaring tool at the tube to be flared and may actuate the locking mechanism (such as via actuating a user input or button or switch) to lock the tube at the appropriate location and depth in the flaring tool, and then may use an impact wrench or other rotational driving means to engage the fastener head of the threaded rod and to rotate the rod to drive the rod through the housing portion, thereby moving the mandrel towards and into engagement with the end of the tube that is to be flared to flare the end of the tube to the desired form or shape. Upon completion of the flaring, the impact wrench or other suitable rotational driving means may be reversed to rotate the threaded rod in the opposite direction to back the mandrel away from the flared end of the tube. Optionally, when the threaded rod is backed away from the tube end, the flaring element or mandrel may be flipped and the threaded rod may again be rotatably driven in the first direction to complete the tube end flaring and processing. Other rotational driving means may be implemented, such as a rotary motor or the like at the hand held flaring tool or such as a manually rotatable drive element, such as a wrench or T-bar or the like, while remaining within the spirit and scope of the present invention.

Thus, the hand held flaring tool of the present invention provides a hand held tool that a user can readily hold and use during the process of clamping onto and engaging an end of a tube or pipe, such as a metallic tube or pipe of a vehicle (such as a brake line or the like). The flaring tool may be used by a user at the vehicle to flare an end of a pipe or tube that is already installed at the vehicle, thereby easing repair work on the tube or pipe or system. The flaring tool may automatically limit the insertion of the end of the tube or pipe to a position that is correct or appropriate for proper flaring of the end of the tube by the flaring mechanism. The flaring mechanism may then be actuated to flare the end of the held tube and, if desired, the flaring mandrel may be readily removed from the tool and reversed, without requiring disassembly of the flaring tool. When the flaring process or processes is/are completed, the flaring tool automatically resets to a configuration for receiving a new tube or pipe therein and for limiting or stopping insertion of the tube or pipe at the desired or appropriate position for the next flaring process or processes.

Therefore, the automatic tube flaring device or tool of the present invention operates to flare the end of a tube, such as a brake line or the like for an automobile, so that the tube may be pressed into engagement with a fitting and secured thereto via a fastener or the like. Typically, the process of flaring a brake line involves first imparting a bubble flare expansion at or near the end of the tube and then forming the flared end via a conical flaring element. Typically, such tools require manually holding on to the die or the like that holds the tube and pressing the flaring tool against the end of the tube and rotating the tube or tool to form the desired end flare.

The automatic flaring tool of the present invention comprises a handle portion, a tube receiver, a large cylinder or actuator and an automatic tube locking device. The tube receiver or receiving end of the tool includes a multi-part (such as four quarters) collet, that, when opened, receives the tube therein and that, when closed or clamped, clamps tightly around the tube to limit or substantially preclude movement of the tube relative to the collet, such that the tube is held in place during the flaring process.

The flaring tool of the present invention provides for an automatic stop whereby, when the tool is in an unlocked position to receive a tube in its receiving end, the tube may be inserted into the opened collet until the end of the tube contacts the stop portion or element, which is automatically positioned at the end of the collet when the collet is in its opened orientation to receive the tube. Thus, the stop element limits insertion of the tube so that the tube is inserted the precise or appropriate amount into the receiver for flaring, and avoids the user having to line up or sight the end of the tube with a guide or the like to attempt to get the tube at an appropriate place for flaring. After the tube is inserted until it hits the stop, the user may actuate or press the locking button or user input, which causes the locking actuator to extend and pivot the lock lever about its pivot axis. When the lock lever is pivoted in this manner, the arms or tabs of the lock lever engage the ring at the collet and pushes the collet along the collar to force the collet portions radially inward to clamp on the tube. Thus, after actuation of the locking button, the tube is locked securely at the precise location for the flaring process. Then, during the flaring operation, the mandrel holder and mandrel are moved towards and into engagement with the end of the tube, while simultaneously moving the stop element out of the way of the end of the tube so that the flaring mandrel can engage the end of the tube to flare the tube.

The collet of the flaring tool of the present invention comprises a multi-piece collet (such as a four-piece collet) that is biased towards its opened position via an internal biasing element or spring, which urges the collet pieces or elements radially outwardly away from the tube when the collet is moved toward the larger diameter end of the collar, while allowing the tube to be disposed within and along the collet and through the internal biasing element. The biasing element may comprise a metallic spring steel element that flexes at four portions and is more rigid at other portions, whereby when the collet is compressed, the inner portions of the biasing spring may flex radially inward to allow for compression of the spring, and when the collar is moved toward the narrower end of the collet, the spring may flex radially outward toward its initial position to expand the collet toward its open position to allow for retraction of the flared tube from the collet and flaring tool. Optionally, other radially expanding elements are contemplated, such as multi-piece spring steel elements or rubber or plastic or resilient or elastomeric biasing elements or the like, that function to exert a radially outward force when at least partially radially compressed, such that when the compression forces are removed, the biasing elements return toward their initial state and expand the collet substantially to allow for retraction of the flared tube for therewithin. The spring or biasing element is disposed in the collet elements and is biased to exert a radially outward force, such that when the collet moves toward the larger diameter end of the collar, the collet elements may expand or move away from one another to substantially enlarge the opening or passageway through the collet to allow the flared end of the tube to pass therethrough when the tube is removed from the tool.

The flaring tool of the present invention also provides a double-ended or reversible mandrel, which may provide for the bubble flaring on one end and the conical flaring on the other end (or other flaring shapes depending on the particular application of the flaring tool and desired final formed shape of the end of the tube). Thus, a single mandrel may be inserted into the tool and after the bubble flaring operation is done, the mandrel may be flipped 180 degrees to perform the conical flaring as well, without having to insert a different mandrel for each flaring process (as would have to be done to switch between conventional mandrels. Typically, flaring mandrels for the manual flaring-type tools known in the art are switched or swapped from one to the other for different flaring purposes and, thus, require additional parts and components and add to the difficulties in flaring the pipes, particularly when such flaring processes are being done to parts that are already installed on vehicles.

The flaring tool of the present invention also provides a larger step up actuator or cylinder that uses multiple pistons to increase the force applied by the output end of the cylinder in response to an air pressure at an input end of the cylinder. The flaring actuator may comprise a three or four stage actuator (or more or less), whereby an inward air pressure at one end may result in a substantially high output force at the output end of the cylinder, due to the progressively increased output forces exerted by the series of pistons and cylinders. The actuator allows for high forces to be slowly applied to the end of the tube in a controlled manner to flare the tube in a manner that limits or substantially precludes damage to the end of the tube during the flaring process.

Thus, the present invention provides an automatic setting of the depth of insertion by the collet and stop element, such that any user can take a tube and insert it into the end of the receiving tube until it hits the stop plate, whereby the depth of insertion is accurately and precisely set to the proper depth for flaring of that tube. The user may then readily push the locking button which clamps the collet onto the tube. The user then pushes the flaring button on the handle to cause the flaring actuator to push the mandrel forward towards the tube, while simultaneously pivoting the stop element out of the way from the end of the tube so that the end of the tube is accessible for the flaring process, and into engagement with the tube to impart the desired flare or deformation to the end of the tube. The output shaft of the flaring actuator may exert, for example, about two thousand pounds of force in response to only, for example, a couple hundred psi of air pressure at its input end. After the bubble flaring process, the mandrel may be moved back to its starting position, whereby the user may remove the mandrel and flip it 180 degrees and repeat the flaring process to complete the flare at the end of the tube. When the tube is flared, the user may press the locking button a second time, which causes the actuator to pull back on the locking lever or link, which allows the collet to move toward the larger diameter end of the collar (responsive to the radial expansion of the spring within the collet), and when the mandrel is retracted after the flaring process, the locking element again pivots so as to be in front of the end of the tube for limiting insertion of the next tube. When the collet has fully expanded (such that the internal diameter of the collet is roughly double what the diameter is when in the locked position), the flared tube may be readily retracted from the collet and flaring tool, with the stop element being in position for the next tube to be inserted into the flaring tool for repeating the flaring process. Thus, the present invention provides that a hand held flaring tool that is fully automatic and easy to use, and does not require lining up or sighting the end of the tube with any guides or the like to properly flare the tube and does not require handling the tube during the flaring process, due to the clamping of the tube by the collet. Thus, a user can flare a tube by basically inserting the tube in until it hits the stop plate and then pressing first the locking button and then the flaring button with no further manual intervention required.

Changes and modifications to the specifically-described embodiments may be carried out without departing from the principles of the present invention, which is intended to be limited only by the scope of the appended claims, as interpreted according to the principles of patent law, including the doctrine of equivalents.

The invention claimed is:

1. A hand held flaring tool for flaring an end of a pipe or tube, said hand held flaring tool comprising:

a receiving portion configured for receiving the tube therein for flaring the end of the tube;

a stop element that is movably disposed at said receiving portion and is movable between a stopping position, where said stop element limits insertion of the tube in said receiving portion to set the tube at an appropriate location for flaring the end of the tube, and a flaring position, where said stop element is moved to be remote from the end of the tube;

a locking mechanism operable to lock the tube at said receiving portion when said stop element is at said stopping position and when the tube is inserted into engagement with said stop element;

a flaring mechanism operable to move a flaring mandrel towards and into engagement with the end of the tube to flare the end of the tube, when said stop element is moved to said flaring position; and a handle portion configured for a user of said flaring tool to grasp and support said flaring tool while the user actuates said flaring mechanism;

wherein said locking mechanism is powered via a first powered actuator, and wherein said first powered actuator is actuated to lock the tube at said receiving portion responsive to user actuation of a first user input at or near said handle portion;

wherein said flaring mechanism is powered via a second powered actuator, and wherein said second powered actuator is actuated to move said flaring mandrel responsive to user actuation of a second user input at or near said handle portion; and wherein said second user input is disposed on said handle portion.

2. The hand held flaring tool of claim 1, wherein said locking mechanism comprises a multi-piece collet that has a plurality of collet portions and that receives the tube therethrough and that is movable relative to a collar to cause collapsing of said collet onto the tube to clamp and secure the tube relative to said collet and said receiving portion, and wherein said handle portion is configured for the user of said flaring tool to grasp and support said flaring tool while the user actuates said locking mechanism.

3. The hand held flaring tool of claim 2, wherein said collet comprises an internal biasing element that urges said collet portions away from the tube when said collet is positioned relative to said collar to allow for expansion of said collet.

4. The hand held flaring tool of claim 2, wherein said collar comprises a wider end and a narrower end opposite said wider end, and wherein said locking mechanism comprises a lever arm that is pivoted via actuation of a locking actuator to impart a longitudinal movement of said collet into said collar of said receiving portion to urge said collet towards said narrower end of said collar to collapse said collet onto the tube to clamp and secure the tube relative to said collet and said receiving portion.

5. The hand held flaring tool of claim 4, wherein an outer surface of said collet comprises a generally conical shaped portion and a smaller diameter portion having a diameter smaller than said generally conical shaped portion of said outer surface, wherein an inner surface of said collar comprises a generally conical shaped portion and a larger diameter portion having a diameter larger than said generally conical shaped portion of said inner surface, wherein said collet is expandable when said generally conical shaped portion of said collet is at said larger diameter portion of said collar, and wherein said collet is collapsed when said generally conical shaped portion of said collet is urged into and along said generally conical shaped portion of said inner surface of said collar.

6. The hand held flaring tool of claim 1, wherein said stop element includes a biasing element that urges said stop element towards said stopping position for engagement with the end of the tube inserted into said receiving portion.

7. The hand held flaring tool of claim 6, wherein, upon actuation of said flaring mechanism, movement of said flaring mandrel towards the end of the tube causes said stop element to move to said flaring position.

8. The hand held flaring tool of claim 1, wherein movement of said flaring mandrel causes a portion of one of (a) a flaring mandrel holder and (b) said flaring mandrel to engage a portion of said stop element to move said stop element to be remote from the end of the tube.

9. The hand held flaring tool of claim 1, wherein said flaring mandrel comprises a reversible flaring mandrel having a first flaring end and a second flaring end opposite said first flaring end, and wherein said first and second flaring ends provide different flaring sizes or shapes, and wherein said reversible flaring mandrel is removable from said flaring tool and configured to be selectively positioned at said flaring tool to position a selected one of said first and second flaring ends at the flaring position for engaging with the end of the tube during the flaring process.

10. The hand held flaring tool of claim 9, wherein said flaring mandrel is accessible through a side window of a housing disposed at an end of said flaring mechanism to allow a user to remove said flaring mandrel without disassembling said receiving portion of said flaring tool.

11. The hand held flaring tool of claim 10, wherein a mandrel holder of said flaring tool supports said flaring mandrel, and wherein said mandrel holder includes at least one retaining element for retaining said reversible flaring mandrel at the selected position at said mandrel holder during the flaring process.

12. The hand held flaring tool of claim 11, wherein said flaring mandrel comprises a metallic flaring mandrel and wherein said mandrel holder includes at least one magnetic retaining element for magnetically attracting said metallic flaring mandrel to retain said metallic flaring mandrel at said mandrel holder.

13. The hand held flaring tool of claim 1, wherein said second powered actuator of said flaring mechanism comprises a multi-stage cylinder operable to move said flaring mandrel towards and into engagement with the end of the tube responsive to pressurized air or fluid at an inlet end of said cylinder.

14. The hand held flaring tool of claim 1, wherein said flaring mechanism comprises a threaded rod threadedly received at a housing portion of said flaring tool, said threaded rod having one end engagable with said flaring mandrel and an opposite end engagable with a rotational driving device, and wherein said rotational driving device is operable to rotatably drive said threaded rod to move said flaring mandrel towards and into engagement with the end of the tube to flare the end of the tube.

15. A hand held flaring tool for flaring an end of a pipe or tube, said hand held flaring tool comprising:

a receiving portion configured for receiving the tube therein for flaring the end of the tube;

a stop element that is movably disposed at said receiving portion and is movable between a stopping position, where said stop element limits insertion of the tube in said receiving portion to set the tube at an appropriate location for flaring the end of the tube, and a flaring position, where said stop element is remote from the end of the tube;

a locking mechanism operable to lock the tube at said receiving portion when said stop element is at said stopping position and when the tube is inserted into engagement with said stop element;

wherein said locking mechanism comprises a multi-piece collet that has a plurality of collet portions and that receives the tube therethrough and that is movable relative to a collar of said receiving portion to cause collapsing of said collet onto the tube to clamp and secure the tube relative to said collet and said receiving portion, and wherein said collet comprises an internal biasing element that urges said collet portions away from the tube when said collet is positioned relative to said collar to allow for expansion of said collet;

wherein said collet comprises a generally conical outer surface and wherein said collar comprises a generally conical inner surface having a wider end and a narrower end, and wherein said collet is moved towards said narrower end of said generally conical inner surface of said collar to cause collapsing of said collet onto the tube;

a flaring mechanism operable to move a flaring mandrel towards and into engagement with the end of the tube to flare the end of the tube, when said stop element is moved to said flaring position;

a handle portion configured for a user of said flaring tool to grasp and support said flaring tool while the user actuates said locking mechanism and said flaring mechanism;

wherein said locking mechanism is powered via a first powered actuator that is operable to lock the tube at said receiving portion in response to user actuation of a first user input at or near said handle portion;

wherein said flaring mechanism is powered via a second powered actuator that is operable to move said flaring mandrel in response to user actuation of a second user input at or near said handle portion; and wherein said second user input is disposed on said handle portion.

16. The hand held flaring tool of claim 15, wherein said locking mechanism comprises a lever arm that is pivoted via actuation of a locking actuator to impart a longitudinal movement of said collet into said collar of said receiving portion to urge said collet towards said narrower end of said conical inner surface of said collar for collapsing said collet onto the tube to clamp and secure the tube relative to said collet and said receiving portion.

17. The hand held flaring tool of claim 16, wherein outer surface of said collet comprises a generally conical shaped portion and a smaller diameter portion having a diameter smaller than said generally conical shaped portion of said outer surface, wherein said inner surface of said collar comprises a generally conical shaped portion and a larger diameter portion having a diameter larger than said generally conical shaped portion of said inner surface, wherein said collet is expandable when said generally conical shaped portion of said collet is at said larger diameter portion of said collar, and wherein said collet is collapsed when said generally conical shaped portion of said collet is urged into and along said generally conical shaped portion of said inner surface of said collar.

18. The hand held flaring tool of claim 17, wherein said outer surface of said collet comprises a curved transition portion between said generally conical shaped portion and said smaller diameter portion and wherein said collar comprises a curved transition portion between said generally conical shaped portion and said larger diameter portion.

19. The hand held flaring tool of claim 18, wherein said curved transition portions engage one another as said generally conical shaped portion of said outer surface of said collet is moved towards said generally conical shaped portion of said inner surface of said collar to urge said collet towards a collapsed state.

20. The hand held flaring tool of claim 15, wherein said flaring tool comprises a biasing element that urges said stop element towards said stopping position for engagement with the end of the tube inserted into said receiving portion.

21. The hand held flaring tool of claim 20, wherein movement of said flaring mandrel causes a portion of a flaring mandrel holder or of said flaring mandrel to engage a portion of said stop element to move said stop element to be remote from the end of the tube.

22. The hand held flaring tool of claim 21, wherein said flaring mandrel comprises a reversible flaring mandrel having a first flaring end and a second flaring end opposite said first flaring end, and wherein said first and second flaring ends provide different flaring sizes or shapes, wherein said reversible flaring mandrel is removable from a flaring mandrel holder of said flaring tool and configured to be selectively positioned at said flaring tool to position a selected one of said first and second flaring ends at the flaring position for engaging with the end of the tube during the flaring process, wherein said flaring mandrel is accessible through a side window to allow a user to remove said flaring mandrel without disassembling said receiving portion of said flaring tool, wherein said mandrel holder of said flaring tool supports said flaring mandrel, and wherein said mandrel holder includes at least one retaining element for retaining said reversible flaring mandrel at the selected position at said mandrel holder during the flaring process.

23. The hand held flaring tool of claim 15, wherein said second powered actuator is operable to move said flaring mandrel towards and into engagement with the end of the tube responsive to pressurized air or fluid at an inlet end of said second powered actuator, and wherein said handle portion includes a generally cylindrical shaped grip that is attached at and extends from said second powered actuator.

24. The hand held flaring tool of claim 15, wherein said flaring mechanism comprises a threaded rod threadedly received at a housing portion of said flaring tool, said threaded rod having one end engagable with said flaring mandrel and an opposite end engagable with a rotational driving device, and wherein said rotational driving device is operable to rotatably drive said threaded rod to move said flaring mandrel towards and into engagement with the end of the tube to flare the end of the tube.

25. A hand held flaring tool for flaring an end of a pipe or tube, said flaring tool comprising:

a receiving portion configured for receiving the tube therein for flaring the end of the tube;

a stop element that is movably disposed at said receiving portion and is movable between a stopping position, where said stop element limits insertion of the tube in said receiving portion to set the tube at an appropriate location for flaring the end of the tube, and a flaring position, where said stop element is moved remote from the end of the tube;

a locking mechanism operable to lock the tube at said receiving portion when said stop element is at said stopping position and when the tube is inserted into engagement with said stop element;

a flaring mechanism operable, when said stop element is moved to said flaring position, to move a flaring mandrel towards and into engagement with the end of the tube to flare the end of the tube;

wherein said flaring mandrel comprises a reversible flaring mandrel having a first flaring end and a second flaring end opposite said first flaring end, and wherein said first and second flaring ends provide different flaring sizes or shapes;

wherein said reversible flaring mandrel is removable from said flaring tool and configured to be selectively positioned at said flaring tool to position a selected one of said first and second flaring ends at the flaring position for engaging with the end of the tube during the flaring process;

a handle portion configured for a user of said flaring tool to grasp and support said flaring tool during the flaring process;

wherein said locking mechanism is operated via a first powered actuator, and wherein said first powered actuator is actuated to lock the tube in the appropriate location for flaring at said receiving portion in response to user actuation of a first user input at or near said handle portion;

wherein said flaring mechanism is operated via a second powered actuator, and wherein said second powered actuator is actuated to move said flaring mandrel to flare the end of the tube in response to user actuation of a second user input at or near said handle portion; and wherein said second user input is disposed on said handle portion.

26. The hand held flaring tool of claim 25, wherein said flaring mandrel is accessible through a side window of a housing that houses said locking mechanism to allow a user to remove said flaring mandrel without disassembling said receiving portion of said flaring tool.

27. The hand held flaring tool of claim 25, wherein a mandrel holder of said flaring tool supports said flaring mandrel, wherein said mandrel holder includes at least one retaining element for retaining said flaring mandrel at the selected position at said mandrel holder during the flaring process while the tube is locked at the receiving portion by said locking mechanism.

28. The hand held flaring tool of claim 27, wherein said flaring mandrel comprises a metallic flaring mandrel and wherein said mandrel holder includes at least one magnetic retaining element for magnetically attracting said metallic flaring mandrel to retain said metallic flaring mandrel at said mandrel holder.

29. The hand held flaring tool of claim 25, wherein said second powered actuator is operable to move said flaring mandrel towards and into engagement with the end of the tube responsive to pressurized air or fluid at an inlet end of said second powered actuator.

30. The hand held flaring tool of claim 25, wherein said flaring mechanism comprises a threaded rod threadedly received at a housing portion of said flaring tool, said threaded rod having one end engagable with said flaring mandrel and an opposite end engagable with a rotational driving device, and wherein said rotational driving device is operable to rotatably drive said threaded rod to move said flaring mandrel towards and into engagement with the end of the tube to flare the end of the tube.

31. A hand held flaring tool for flaring an end of a pipe or tube, said hand held flaring tool comprising:

a handle and a body, wherein said handle is configured to be held by a user operating said hand held flaring tool for supporting said body of said flaring tool away from a floor surface;

a securing user input at or near the handle and a flaring user input on the handle, whereby said securing and flaring user inputs are accessible and operable by the user holding said handle;

wherein said body comprises a receiving portion configured for receiving the tube therein for flaring the end of the tube;

a stop element that is movably disposed at said receiving portion and is movable to a stopping position, where said stop element limits insertion of the tube in said receiving portion to set the tube at an appropriate location for flaring the end of the tube;

a securing mechanism operable to secure the tube at said receiving portion when said stop element is at said stopping position and when the tube is inserted into engagement with said stop element;

wherein said securing mechanism secures the tube at said receiving portion responsive to actuation of said securing user input;

a flaring mechanism operable, responsive to actuation of said flaring user input, to move a flaring mandrel at the end of the tube to flare the end of the tube;

wherein said securing mechanism is operated via a first powered actuator, and wherein said flaring mechanism is operated via a second powered actuator, and wherein said first and second powered actuators are actuated in response to user actuation of said securing user input and said flaring user input, respectively.

32. The hand held flaring tool of claim 31, wherein said stop element includes a biasing element that urges said stop element towards said stopping position for engagement with the end of the tube inserted into said receiving portion.

33. The hand held flaring tool of claim 32, wherein movement of said flaring mandrel towards the end of the tube causes said stop element to move to a flaring position, where said stop element is remote from the end of the tube.

34. The hand held flaring tool of claim 31, wherein movement of said flaring mandrel causes a portion of one of (a) a flaring mandrel holder and (b) said flaring mandrel to engage a portion of said stop element to move said stop element to be remote from the end of the tube.

35. The hand held flaring tool of claim 31, wherein said flaring mandrel comprises a reversible flaring mandrel having a first flaring end and a second flaring end opposite said first flaring end, and wherein said first and second flaring ends provide different flaring sizes or shapes, and wherein said reversible flaring mandrel is removable from said flaring tool and configured to be selectively positioned at said flaring tool to position a selected one of said first and second flaring ends at a flaring position for engaging with the end of the tube during the flaring process.

36. The hand held flaring tool of claim 35, wherein said flaring mandrel is accessible through a side window of said body to allow a user to remove said flaring mandrel without disassembling said body of said flaring tool.

37. The hand held flaring tool of claim 36, wherein a mandrel holder of said flaring tool supports said flaring mandrel, and wherein said mandrel holder includes at least one retaining element for retaining said reversible flaring mandrel at the selected position at said mandrel holder during the flaring process.

38. The hand held flaring tool of claim 31, wherein said second powered actuator of said flaring mechanism comprises a multi-stage cylinder operable to move said flaring mandrel towards and into engagement with the end of the tube responsive to pressurized air or fluid at an inlet end of said cylinder.

39. The hand held flaring tool of claim 31, wherein said securing mechanism comprises a multi-piece collet that has a plurality of collet portions and that receives the tube therethrough and that is movable relative to a collar of said receiving portion to cause collapsing of said collet onto the tube to clamp and secure the tube relative to said collet and said receiving portion, and wherein said collet comprises an internal biasing element that urges said collet portions away from the tube when said collet is positioned relative to said collar to allow for expansion of said collet, wherein said collet comprises a generally conical outer surface and wherein said collar comprises a generally conical inner surface having a wider end and a narrower end, and wherein said collet is moved towards said narrower end of said generally conical inner surface of said collar to cause collapsing of said collet onto the tube.

40. The hand held flaring tool of claim 39, wherein said securing mechanism comprises a lever arm that is pivoted via actuation of a securing actuator via actuation of said securing user input to impart a longitudinal movement of said collet into said collar of said receiving portion to urge said collet towards said narrower end of said conical inner surface of said collar for collapsing said collet onto the tube to clamp and secure the tube relative to said collet and said receiving portion.

41. The hand held flaring tool of claim 40, wherein said outer surface of said collet comprises a generally conical shaped portion and a smaller diameter portion having a diameter smaller than said generally conical shaped portion of said outer surface, wherein said inner surface of said collar comprises a generally conical shaped portion and a larger diameter portion having a diameter larger than said generally conical shaped portion of said inner surface, wherein said collet is expandable when said generally conical shaped portion of said collet is at said larger diameter portion of said collar, and wherein said collet is collapsed when said generally conical shaped portion of said collet is urged into and along said generally conical shaped portion of said inner surface of said collar.

42. The hand held flaring tool of claim 41, wherein said outer surface of said collet comprises a curved transition portion between said generally conical shaped portion and said smaller diameter portion and wherein said collar comprises a curved transition portion between said generally conical shaped portion and said larger diameter portion.

43. The hand held flaring tool of claim 42, wherein said curved transition portions engage one another as said generally conical shaped portion of said outer surface of said collet is moved towards said generally conical shaped portion of said inner surface of said collar to urge said collet towards a collapsed state.

44. The hand held flaring tool of claim 31, wherein said securing mechanism comprises a multi-piece collet that has a plurality of collet portions and that receives the tube therethrough and that is movable relative to said collar of said receiving portion to cause collapsing of said collet onto the tube to clamp and secure the tube relative to said collet and said receiving portion, and wherein said collet comprises an internal biasing element that urges said collet portions away from the tube when said collet is positioned relative to said collar to allow for expansion of said collet.

45. The hand held flaring tool of claim 31, wherein said stop element is movable to a flaring position, where said stop element is moved to be remote from the end of the tube, and wherein said stop element is moved to said flaring position responsive to said flaring mechanism moving said flaring mandrel at the end of the tube to flare the end of the tube.

46. The hand held flaring tool of claim 31, wherein said flaring mandrel comprises a movable flaring mandrel having a first flaring portion and a second flaring portion, and wherein said first and second flaring portions provide different flaring sizes or shapes, and wherein said movable flaring mandrel is movable and positionable at said flaring tool to provide a selected one of said first and second flaring portions at a flaring position for engaging with the end of the tube during the flaring process.

47. The hand held flaring tool of claim 46, wherein said flaring mandrel is accessible through a window of said body to allow a user to move said flaring mandrel without disassembling said receiving portion of said flaring tool.

48. The hand held flaring tool of claim 47, wherein a mandrel holder of said flaring tool supports said flaring mandrel, and wherein said mandrel holder includes at least one retaining element for retaining said movable flaring mandrel at the selected position at said mandrel holder during the flaring process.

* * * * *